US008440872B2

(12) United States Patent
Buchanan et al.

(10) Patent No.: US 8,440,872 B2
(45) Date of Patent: May 14, 2013

(54) PROCESS FOR PREPARING POLY ALPHA OLEFINS AND LUBRICANT BASESTOCKS FROM FISCHER-TROPSCH LIQUIDS

(75) Inventors: John S. Buchanan, Lambertville, NJ (US); Margaret M. Wu, Skillman, NJ (US); Lorenzo DeCaul, Langhorne, PA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 795 days.

(21) Appl. No.: 11/973,281

(22) Filed: Oct. 5, 2007

(65) Prior Publication Data

US 2009/0093657 A1 Apr. 9, 2009

(51) Int. Cl.
*C07C 2/22* (2006.01)

(52) U.S. Cl.
USPC ..... 585/532; 585/324; 585/329; 585/330; 585/502; 585/518; 585/519; 585/520; 585/530

(58) Field of Classification Search ..... 585/520, 585/530, 329, 330, 324, 502, 518, 519, 532; 208/950
See application file for complete search history.

(56) References Cited

U.S. PATENT DOCUMENTS

| | | | | |
|---|---|---|---|---|
| 4,513,156 | A | 4/1985 | Tabak | |
| 4,579,986 | A * | 4/1986 | Sie | 585/324 |
| 5,136,118 | A * | 8/1992 | Buchanan et al. | 585/255 |
| 5,146,022 | A | 9/1992 | Buchanan et al. | |
| 5,208,403 | A | 5/1993 | Buchanan et al. | |
| 5,276,229 | A * | 1/1994 | Buchanan et al. | 585/255 |
| 6,398,946 | B1 | 6/2002 | O'Rear et al. | |
| 6,548,723 | B2 * | 4/2003 | Bagheri et al. | 585/517 |
| 6,602,922 | B1 | 8/2003 | Davis et al. | |
| 6,700,027 | B1 | 3/2004 | Johnson et al. | |
| 6,855,248 | B1 * | 2/2005 | Olivier et al. | 208/366 |
| 2002/0003102 | A1 | 1/2002 | O'Rear et al. | |
| 2003/0199719 | A1 * | 10/2003 | Johnson et al. | 585/329 |
| 2003/0232937 | A1 * | 12/2003 | DiMaio | 526/127 |
| 2004/0029984 | A1 | 2/2004 | Johnson et al. | |
| 2004/0044090 | A1 * | 3/2004 | Font Freide et al. | 518/700 |
| 2004/0068150 | A1 * | 4/2004 | Johnson et al. | 585/324 |
| 2004/0178118 | A1 * | 9/2004 | Rosenbaum et al. | 208/18 |
| 2004/0267070 | A1 | 12/2004 | Johnson et al. | |
| 2004/0267071 | A1 | 12/2004 | Harris et al. | |
| 2005/0016899 | A1 | 1/2005 | Abazajian | |
| 2005/0148806 | A1 | 7/2005 | Cruijsberg et al. | |
| 2005/0245778 | A1 | 11/2005 | Johnson et al. | |

FOREIGN PATENT DOCUMENTS

| | | | |
|---|---|---|---|
| EP | 0 583 072 | A1 | 2/1994 |
| EP | 0 791 643 | A1 | 8/1997 |
| EP | 0 791 644 | A1 | 8/1997 |
| WO | WO 98/52888 | | 11/1998 |
| WO | WO 01/46340 | A1 | 6/2001 |

OTHER PUBLICATIONS

Seador, et al., "Distillation" in Perry's Chemical Engineer's Handbook, 7th ed., R. W. Perry and D. W. Green, eds., McGraw-Hill, (1997), available on-line at www.knovel.com.*

Speight, Lange's Handbook of Chemistry, 16th ed., McGraw-Hill, 2007, month unknown.*

P. Kruger, "Petrochemicals from Fischer-Tropsch: Diversification from Fuels into Chemicals", Abstract Attached.

F. H. Dressler et al., "The Cationic Oligomerization of C10 Fischer-Tropsch Olefins and of 1-Decene", Abstract Attached.

* cited by examiner

*Primary Examiner* — In Suk Bullock
*Assistant Examiner* — Bradley Etherton
(74) *Attorney, Agent, or Firm* — Robert A. Migliorini

(57) ABSTRACT

A process for preparing poly alpha olefins from a Fisher-Tropsch product. The process comprising the steps of contacting a $C_5$-$C_{18}$ fraction of an alpha-olefinic hydrocarbon mixture produced from thermal cracking a $C_{16}$-$C_{40}$ Fisher-Tropsch product with an oligomerization catalyst under conditions to produce an oligomerized product; and fractionating the oligomerized product to obtain a fractionated product having an average carbon number greater than 30. A process for preparing lubricant base stocks from a Fisher-Tropsch product is also provided.

17 Claims, No Drawings

PROCESS FOR PREPARING POLY ALPHA OLEFINS AND LUBRICANT BASESTOCKS FROM FISCHER-TROPSCH LIQUIDS

FIELD

Disclosed herein is a process for upgrading Fischer-Tropsch products to poly alpha olefins and lubricants.

BACKGROUND

Conventional mineral oil based lubricants are produced by a separative sequence carried out in the lube refinery that includes fractionation of a paraffinic crude under atmospheric pressure followed by fractionation under vacuum to produce distillate fractions, such as neutral oils, and a residual fraction which, after deasphalting and severe solvent treatment, may also be used as a lubricant base stock, usually referred as a bright stock. Neutral oils, after solvent extraction to remove low viscosity index (VI) components, are conventionally subjected to dewaxing, either by solvent or catalytic dewaxing processes, to obtain a desired pour point, after which the dewaxed lube stock may be hydrofinished to improve stability and remove color bodies. This conventional technique relies upon the selection and use of crude stocks, usually of a paraffinic character, which produce the desired lube fractions of the desired qualities in adequate amounts.

The range of permissible crude sources for lubricant production may be extended by a lube hydrocracking process that is capable of utilizing crude stocks of marginal quality, often having a higher aromatic content than the best paraffinic crudes. The lube hydrocracking process generally includes an initial hydrocracking step carried out under high pressure in the presence of a bifunctional catalyst that effects partial saturation and ring opening of the aromatic components present in the feed. The hydrocracked product is then subjected to dewaxing in order to reach the target pour point.

Conventional mineral oil lubricants have been challenged to match the lubrication demands of modern automotive engines. Current trends in the design of automotive engines have yielded higher operating temperatures, requiring higher quality lubricants. This has resulted in the need for lubricants having higher viscosity indices. High VI values have conventionally been attained by the use of VI improvers, such as polyacrylates, but there is a limit to the degree of improvement which may be effected in this manner. In addition, VI improvers tend to undergo degradation under the effects of high temperatures and high shear rates, with more stressing conditions producing even faster degradation of oils having significant amounts of VI improvers.

Synthetic lubricants produced by the polymerization of alpha olefins in the presence of certain catalysts have been shown to possess excellent VI characteristics. However, historically, they have been expensive to produce by conventional synthetic procedures and usually require expensive starting materials.

Another approach to the production of high VI oils has been to subject petroleum waxes to severe hydrotreatment over amorphous lube hydrocracking catalysts, followed by dewaxing to a target pour point. In processes of this type, hydroisomerization of the wax takes place to form high VI iso-paraffins of low pour point. In processes of this kind, the catalyst is typically a bifunctional catalyst containing a metal hydrogenation component on an amorphous acidic support. The metal component is usually a combination of base metals, with one metal selected from the iron group (Group VIII) and one metal from Group VIB of the Periodic Table, for example, nickel in combination with molybdenum or tungsten. Modifiers such as phosphorus or boron may be present. The activity of the catalyst may be increased by the use of fluorine, either by incorporation into the catalyst during its preparation in the form of a suitable fluorine compound or by in situ fluoriding during the operation of the process.

Other processes useful in the production of synthetic lubricants employ oligomerization with a Lewis acid catalyst such as promoted BF3 or $AlCl_3$. Such processes are described in U.S. Pat. Nos. 5,136,118 and 5,146,022, the contents of which are hereby incorporated by reference for such details.

Specific automotive engine lubricant oil formulations, such as 10W-30 engine oil, have required the use of specific lubricant base stock in order to provide the requisite viscosity, lubricity, high viscosity index and other properties. In turn, the production of the specific lube base stock has been locked into certain raw materials and processes capable of producing lube stock with the requisite properties.

Products prepared from the Fischer-Tropsch process comprise a mixture of various solid, liquid, and gaseous hydrocarbons. Those Fischer-Tropsch products which boil within the range of lubricating base oil and diesel are usually of higher value than lower boiling products, such as naphtha, or normally gaseous products, such as LPG. As may be appreciated, it is advantageous to capture the carbon value of the lower boiling and normally gaseous products by upgrading them to higher molecular weight and higher value products.

Lubricating base oils may be prepared from the Fischer-Tropsch wax recovered as one of the products of the Fischer-Tropsch synthesis. Lubricating base oils typically will have an initial boiling point above 315° C. (600° F.). Accordingly, it is desirable to be able to maximize the yields of such higher value hydrocarbon products which boil within the range of lubricating base oils.

Fischer-Tropsch products, as they are initially recovered from the Fischer-Tropsch reactor, contain varying amounts of olefins depending upon the type of Fischer-Tropsch operation employed. In addition, the crude Fischer-Tropsch product also contains a certain amount of oxygenated hydrocarbons, especially alcohols, which have been reported to act as a poison to most oligomerization catalysts. To address this issue, it has been proposed to remove these oxygenates through a hydrotreating step, or, alternatively, converting them to olefins by a dehydration step. The olefins originally present in the Fischer-Tropsch products or derived from converted oxygenates may be oligomerized to yield hydrocarbons having a higher molecular weight than the original feed.

As may be appreciated, there is a continuing need for automotive lubricants which are based on fluids of high viscosity index and which are stable under the high temperature, high shear rate conditions encountered in modern engines.

U.S. Pat. No. 5,136,118 proposes a process is disclosed for the production of synthetic hydrocarbon lubricants having high viscosity index by oligomerizing a mixture of alpha-olefins comprising the reaction product from the thermal cracking of refined wax. The oligomerization is carried out with Lewis acid catalyst or reduced chromium oxide on porous support.

U.S. Pat. No. 5,146,022 proposes a process is disclosed for the production of synthetic lubricants having high viscosity index and thermal stability by oligomerizing a mixture of $C_5$-$C_{18}$ or alpha-olefins produced from the thermal cracking of slack wax or recycled slack wax. The oligomerization is carried out with Lewis acid catalyst. In one form, promoted aluminum chloride may be used as the catalyst.

U.S. Pat. No. 5,208,403 proposes lubricant compositions that comprise blends or mixtures of low viscosity, HVI lube basestock with higher viscosity, HVI PAO lube basestock produced from slack wax by thermal cracking to alpha olefins followed by Lewis acid catalyzed oligomerization of the mixture to a lube base stock. Blending these components in appropriate proportions produces lube basestock having viscosities in the range of 8-15 cS (100° C.) from which material suitable for the formulation of 10W-30 automobile engine lube can be produced. The blends are said to possess VI values greater than that of either component of the blend.

U.S. Pat. No. 5,276,229 proposes a process for the production of synthetic lubricants having high viscosity index by oligomerizing a mixture of alpha-olefins produced from the thermal cracking of slack wax or recycled slack wax. The oligomerization is carried out with a reduced metal oxide catalyst, such as a carbon monoxide reduced chromium oxide on a silica support. The olefin product from the thermal cracking step is purified by purification steps, such as adsorption of impurities by molecular sieve or oxygenates removal catalysts, or by selectively hydrotreating to remove any dienes prior to the oligomerization step.

U.S. Pat. No. 6,700,027 proposes a process for increasing the yield of $C_{10}$ plus hydrocarbon products from a Fischer-Tropsch plant which comprises recovering a Fischer-Tropsch condensate fraction boiling below 70° F. from the Fischer-Tropsch plant, wherein said fraction contains at least 10 weight percent or more olefins, contacting the olefins in the Fischer-Tropsch condensate fraction under oligomerization conditions, at a reaction temperature between 650° F. and 800° F. with an oligomerization catalyst comprising active chromium on an inert support and recovering a $C_{10}$ plus hydrocarbon product.

U.S. Patent Publication No. 2005/0148806 proposes a method for the preparation of lower olefins by steam cracking, wherein the feed containing heavy hydrocarbons obtained by Fischer-Tropsch synthesis is subjected to steam cracking in a naphtha-designed steam cracking furnace for steam cracking the Fischer-Tropsch hydrocarbons into the lower olefins.

Many of the prior patents and literature teach the presence of large amount of oxygenated compounds in Fischer-Tropsch wax products. These oxygenates may interfere with the cracking process and if they survive the cracking conditions, they may interfere with the polymerization steps.

Despite these advances in the art, there is a continuing need for a process for preparing poly alpha olefins and lubricant base stocks from Fisher-Tropsch products.

SUMMARY

In one aspect, provided is a process for preparing poly alpha olefins from a Fisher-Tropsch product. The process includes the steps of contacting a $C_5$-$C_{18}$ fraction of an alpha-olefinic hydrocarbon mixture produced from thermal cracking a $C_{16}$-$C_{40}$ Fisher-Tropsch product with an oligomerization catalyst under conditions to produce an oligomerized product and fractionating the oligomerized product to obtain a fractionated product having an average carbon number greater than 24.

In another aspect, provided is a process for preparing lubricant base stocks from a Fisher-Tropsch product. The process includes the steps of thermally processing a $C_{16}$-$C_{40}$ Fisher-Tropsch product to obtain a product containing at least 60% linear alpha-olefins, separating a $C_5$-$C_{18}$ fraction from the thermally processed product, contacting the $C_5$-$C_{18}$ fraction or a selected fraction from this $C_5$-$C_{18}$ fraction with an oligomerization catalyst under conditions to produce an oligomerized product and fractionating the oligomerized product to obtain a fractionated product having an average carbon number greater than 24.

In one aspect, the oligomerization catalyst includes a Lewis acid catalyst, an activated metal oxide catalyst or an activated metallocene catalyst compound.

In another aspect, the oligomerization catalyst includes aluminum trichloride promoted with water.

In yet another aspect, the oligomerization catalyst includes a lower valence Group VIB metal oxide on an inert support.

In still yet another aspect, the oligomerization catalyst is an activated metallocene catalyst compound and the $C_5$-$C_{18}$ fraction is further contacted with a co-activator.

In a further aspect, the fractionated lube product is contacted with hydrogen and a hydrogenation catalyst.

In a yet further aspect, the hydrogenation catalyst is nickel supported on keisleghur, silica, alumina, clay or silica-alumina.

In a still yet further aspect, the fractionated product is blended with a hydroisomerized Fisher-Tropsch wax product, other light Gr I, II, III, IV, V and VI base stock. These blended products, when properly formulated with additives, are useful as base stocks for finished lubricant products.

These and other features will be apparent from the detailed description.

DETAILED DESCRIPTION

Various aspects will now be described with reference to specific forms selected for purposes of illustration. It will be appreciated that the spirit and scope of the processes disclosed herein is not limited to the selected forms. All numerical values within the detailed description and the claims herein are understood as modified by "about."

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

As used herein, the term "mixture" is meant to include within its scope all forms of mixtures including, but not limited to, simple mixtures as well as blends, etc.

As used herein, the term "Fischer-Tropsch wax" refers to a material that is predominantly a $C_{16}$ plus product that comprises primarily hydrocarbons having 16 or more carbon atoms in the structure of the molecule. $C_{16}$ plus product will have an initial boiling point at the upper end of the boiling range for diesel, i.e., above 600° F. (315° C.).

As used herein, by use of the range $C_6$-$C_{16}$ is meant that 80% of the material in the fraction has carbon numbers that fall between $C_6$ and $C_{16}$. Thus, a $C_6$-$C_{16}$ cut could include an appreciable amount of $C_5$ and $C_{17}$-$C_{18}$ material.

As used herein, by use of the range $C_5$-$C_{18}$ is meant that 80% of the material in the fraction has carbon numbers that fall between $C_5$ and $C_{18}$. Thus, a $C_5$-$C_{18}$ cut could include an appreciable amount of $C_4$ and $C_{19}$-$C_{20}$ material.

As used herein, by use of the range $C_{16}$-$C_{40}$ is meant that 80% of the material in the fraction has carbon numbers that fall between $C_{16}$ and $C_{40}$. Thus, a $C_{16}$-$C_{40}$ cut could include an appreciable amount of $C_{15}$ and $C_{41}$-$C_{42}$ material.

In one form, provided is a process for preparing poly alpha olefins from a Fisher-Tropsch product. The process includes the steps of contacting a $C_5$-$C_{18}$ or a $C_6$-$C_{16}$ fraction of an alpha-olefinic hydrocarbon mixture produced from thermal cracking a $C_{16}$-$C_{40}$ or a $C_{19}$-$C_{27}$ or a $C_{20}$-$C_{25}$ Fisher-Tropsch product with an oligomerization catalyst under conditions to produce an oligomerized product and fractionating the oligomerized product to obtain a fractionated product having an average carbon number greater than 24.

In another form, provided is a process for preparing lubricant base stocks from a Fisher-Tropsch product. The process includes the steps of thermally processing a $C_{16}$-$C_{40}$ or a $C_{19}$-$C_{27}$ or a $C_{20}$-$C_{25}$ Fisher-Tropsch product to obtain a product fraction containing at least 60% linear alpha-olefins, separating a $C_5$-$C_{18}$ or a $C_6$-$C_{16}$ fraction from the thermally processed product, contacting the $C_5$-$C_{18}$ or a $C_6$-$C_{16}$ fraction with an oligomerization catalyst under conditions to produce an oligomerized product and fractionating the oligomerized product to obtain a fractionated product having an average carbon number greater than 30.

As a practical matter, the boiling range of the feed for thermal processing may lie above the boiling range of the thermally processed product that is recovered for use as oligomerization feed. This, as may be appreciated by those skilled in the art, may facilitate separations and recycle; thus the preferred carbon number ranges given above for the feed for thermal processing, and for the olefinic product sent on to oligomerization, do not overlap.

In Fischer-Tropsch synthesis, the starting material is a hydrocarbonaceous feed. The feed may be methane, natural gas, associated gas or a mixture of $C_{1-4}$ hydrocarbons. The feed may comprise more than 90 v/v percent $C_{1-4}$ hydrocarbons or more than 95 percent $C_{1-4}$ hydrocarbons, and may comprise at least 60 v/v percent methane, or at least 75 percent methane, at least 90 percent methane. Also, should there be any sulfur in the feedstock, it may be removed.

The partial oxidation of the hydrocarbonaceous feed produces mixtures of carbon monoxide and hydrogen. Any of the variety of established gasification processes may be employed to accomplish this partial oxidation step. The oxygen containing gas may be air, oxygen enriched air, which may contain up to 70 percent air, or substantially pure air, containing typically at least 95 vol. % oxygen. Oxygen or oxygen enriched air may be produced via cryogenic techniques and can also be produced through the use of a membrane-based process, such as described in U.S. Pat. No. 5,562,754, the contents of which are incorporated herein by reference for such details.

To adjust the $H_2$/CO ratio of the syngas, carbon dioxide and/or steam may be introduced into the partial oxidation process. For example, up to 15% volume based on the amount of syngas, or up to 8% volume, or up to 4% volume of either carbon dioxide or steam may be added to the feed. Water produced in the hydrocarbon synthesis may be used to generate the steam. As a suitable carbon dioxide source, carbon dioxide from the effluent gasses of an expanding/combustion step may be used.

The $H_2$/CO ratio of the syngas may be between 1.5 and 2.3, or between 1.8 and 2.1. If desired, small additional amounts of hydrogen may be made by steam methane reforming, in combination with the water shift reaction. Any carbon monoxide and carbon dioxide produced together with the hydrogen may be used in the hydrocarbon synthesis reaction or recycled to increase the carbon efficiency. Additional hydrogen manufacture may be an option.

The percentage of hydrocarbonaceous feed converted may be 50-99% by weight, or 80-98% by weight, or 85-96% by weight. The gaseous mixture, comprising predominantly hydrogen, carbon monoxide and optionally nitrogen is contacted with a suitable catalyst in the catalytic conversion stage, in which hydrocarbons are formed. At least 70 v/v % of the syngas may be contacted with the catalyst, or at least 80% of the syngas may be contacted with the catalyst, or at least 90% of the syngas may be contacted with the catalyst, or all of the syngas may be contacted with the catalyst.

The catalysts used in for the catalytic conversion of the mixture comprising hydrogen and carbon monoxide are known in the art and are usually referred to as Fischer-Tropsch catalysts. Catalysts for use in the Fischer-Tropsch hydrocarbon synthesis process frequently comprise, as the catalytically active component, a metal from Group VIII of the Periodic Table of Elements. Catalytically active metals include ruthenium, iron, cobalt and nickel.

The catalytically active metal may be supported on a porous carrier. The porous carrier may be selected from any of the suitable refractory metal oxides or silicates or combinations thereof known in the art. Examples of porous carriers include silica, alumina, titania, zirconia, ceria, gallia and mixtures thereof. The amount of catalytically active metal on the carrier may be in the range of from 3 to 300 pbw per 100 pbw of carrier material, or from 10 to 80 pbw, or from 20 to 60 pbw.

If desired, the catalyst may also comprise one or more metals or metal oxides as promoters. Suitable metal oxide promoters may be selected from Groups IIA, IIIB, IVB, VB and VIB of the Periodic Table of Elements, or the actinides and lanthanides. In particular, oxides of magnesium, calcium, strontium, barium, scandium, yttrium, lanthanum, cerium, titanium, zirconium, hafnium, thorium, uranium, vanadium, chromium and manganese are suitable promoters. Metal oxide promoters for the catalyst used to prepare Fischer-Tropsch waxes for use herein are manganese and zirconium oxide. Metal promoters may be selected from Groups VIIB or VIII of the Periodic Table. Rhenium and Group VIII noble metals are suitable, as are platinum and palladium. The amount of promoter present in the catalyst may be in the range of from 0.01 to 100 pbw, or 0.1 to 40, or 1 to 20 pbw, per 100 pbw of carrier.

The catalytically active metal and the promoter, if present, may be deposited on the carrier material by any suitable treatment, such as impregnation, kneading and extrusion. After deposition of the metal and, if appropriate, the promoter on the carrier material, the loaded carrier is typically subjected to calcination at a temperature of generally from 350 to 750° C., or from 450 to 550° C. As may be appreciated by those skilled in the art, the effect of the calcination treatment is to remove crystal water, decompose volatile decomposition products and convert organic and inorganic compounds to their respective oxides. After calcination, the resulting catalyst may be activated by contacting the catalyst with hydrogen or a hydrogen-containing gas, typically at temperatures of 200 to 350° C.

The catalytic conversion process may be performed under conventional synthesis conditions known in the art. Typically, the catalytic conversion may be effected at a temperature in the range of from 100 to 600° C., or from 150 to 350° C., or from 180 to 270° C. Typical total pressures for the catalytic conversion process are in the range of from 1 to 200 bar absolute, or from 10 to 70 bar absolute. In the catalytic conversion process, at least 70 wt %, or 90 wt % of $C_5$+ hydrocarbons are formed.

A Fischer-Tropsch catalyst may be used that yields substantial quantities of normal paraffins and iso-paraffins, or substantially normal paraffins. A suitable catalyst may be a cobalt-containing Fischer-Tropsch catalyst. A portion may boil above the boiling point range of heavy hydrocarbons to normally solid hydrocarbons. The term heavy hydrocarbons as used herein, is a reference to hydrocarbon mixtures of which the boiling point range corresponds substantially to that of kerosene and gas oil fractions obtained in a conventional atmospheric distillation of crude mineral oil. The boiling point range of these heavy hydrocarbons generally lies within the range of from 100-380° C., or from 200-370° C., or from 150-360° C.

Fischer-Tropsch hydrocarbons generally fall within the range of $C_4$-$C_{100}$ hydrocarbons. Normally liquid Fischer-Tropsch hydrocarbons generally fall within the range of $C_4$-$C_{25}$ hydrocarbons, or $C_7$-$C_{23}$ hydrocarbons, or $C_{10}$-$C_{20}$ hydrocarbons, or mixtures thereof. These hydrocarbons or mixtures thereof are liquid at temperatures between 5 and 30° C., at one bar, or at 20° C., at one bar, and usually are paraffinic of nature, while up to 24 wt %, or up to 12 wt %, of either olefins or oxygenated compounds may be present. Depending on the catalyst and the process conditions used in the Fischer Tropsch reaction, normally gaseous hydrocarbons, normally liquid hydrocarbons and normally solid hydrocarbons are obtained. A yield having a large fraction of normally solid hydrocarbons is useful in the processes disclosed herein. These solid hydrocarbons may be obtained up to 85 wt %, based on total hydrocarbons, and usually between 50 and 75 wt %.

The higher boiling range waxy paraffinic hydrocarbons may be subjected to a thermal cracking step under conditions suitable for the production of a crackate or product of the cracking process, containing predominantly alpha olefins. Thermal cracking is well known in the refinery art and the thermal cracking process can be carried out in a variety of process configurations, continuous or batch-wise. Typically, the hot Fischer-Tropsch waxy feed is fed to an empty tube or tubes for the gas-phase cracking. Typically, at least part of the tubular reactor is heated, e.g. in a furnace, to compensate for the endothermic heat of the cracking reaction. Other commercial hydrocarbon cracking or steam thermal cracking conditions can also be used.

The wax is effectively cracked at a temperature between 500° C. to 700° C. and a pressure between 50 kPa and 980 kPa at a liquid hourly space velocity (LHSV) between 0.3 and 20. It has been found that the thermal cracking of Fisher-Tropsch waxy feeds can be conducted at milder conditions than those used for conventional feeds. As indicated below, thermal cracking has been effectively conducted at a temperature of 555° C., a pressure of 103 kPa and a LHSV of 2. In practice, the Fischer-Tropsch waxy feed may be typically diluted with 1 to 70 percent by volume of an inert gas such as light hydrocarbons, nitrogen or steam, such as steam from a commercial plant. Steam is most often used as diluent with beneficial effect of reducing by-products. Generally the cracking is conducted to convert 20 to 60 wt % of the starting paraffins. Usually, lower cracking conversions produces lower amount of by-products, such as di-olefins, alkynes, coke, etc in the product and higher cracking conversion produces higher amount of by-products. For an economical process, an optimized conversion is usually most desirable by balancing per-path olefin yields and by-product formation.

Following thermal cracking, the cracking product is fractionally distilled and fractions having a carbon number of between five and eighteen collected and combined as feedstock for subsequent polymerization to synthetic lubricant. Advantageously, divided-wall distillation columns may be used to minimize the number of distillation columns needed to perform the various fractionations that are required herein. For instance, the $C_{5+}$ thermally cracked product can be passed through a single divided wall column to obtain a $C_5$-$C_{18}$ or a $C_6$-$C_{16}$ stream for oligomerization, plus a light $C_5$-$C_6$ stream (steam cracker feed) and a heavy $C_{17+}$ product to recycle for further cracking.

The oligomerization feedstock mixture typically comprises a $C_5$-$C_{18}$ fraction or $C_6$-$C_{16}$ fraction of olefinic hydrocarbons from fractionation of the thermal cracking product. In one form, a $C_5$-$C_{18}$ olefinic fraction may be used. It has been found that using a narrower cut of olefinic hydrocarbons, such as a $C_6$-$C_{16}$, $C_6$-$C_{14}$ or $C_8$-$C_{12}$ fraction, can improve the lube product properties, but at the cost of reducing lube yields. Decreasing the amount of $C_5$-$C_6$ hydrocarbons in the oligomerization feedstock generally boosts the VI of the lube product, and decreasing the amount of $C_{16}$-$C_{18}$ generally improves lube pour point. However, it has been found that using a feedstock comprising $C_5$-$C_{18}$ or $C_6$-$C_{16}$ hydrocarbons provides lube products with surprisingly high VI. Prior to oligomerization the feedstock may be purified to remove moisture and oxygenated organic compounds such as alcohols, ethers and esters which can interfere with the oligomerizations process. Prior to oligomerization, if the product fraction contains too high an amount of dienes, these dienes can be selectively removed by catalytic hydrogenation by known methods, such as by a process commonly used to remove trace butadiene from $C_4$ streams.

In another form, the following process may be employed. First, a Fischer-Tropsch liquid is heated and light material is flashed or distilled off at a pressure greater than one atmosphere. The bottoms from the separation are sent to a vacuum fractionator, where $C_{19}$ and lighter material is sent overhead, a $C_{20}$-$C_{25}$ fraction is recovered as a side stream and sent to a thermal cracker. The $C_{26+}$ fraction exits via the process bottoms. Conversion of the $C_{19+}$ feed, which is mainly paraffinic, to a $C_{18-}$ fraction, which is mainly olefinic, by weight, is 22 to 35% per pass in the thermal cracker. The effluent from the thermal cracker goes to an atmospheric column, where the $C_{18-}$ stream is taken overhead or as exits as a side stream. The $C_{9+}$ bottoms stream from this column are mainly recycled to the thermal cracker for further cracking. It is understood that the carbon number cut values referred to are approximate, and that distillation cuts in these carbon number ranges are usually characterized by significant overlap in carbon numbers between adjacent fractions, so, for example, and not by way of limitation, a $C_{20}$-$C_{25}$ cut may have appreciable $C_{19-}$ and even more so, appreciable $C_{26+}$ material.

While the feed to the thermal cracker may be first hydrotreated, this is not necessary.

While the feed to the thermal cracker may be solely derived from Fischer-Tropsch liquids, it is within the scope of this disclosure to include up to 30%, by weight, of other hydrocarbon materials to the feed to the thermal cracker.

Lewis Acid Catalysts

Oligomerization may be carried out using a Lewis acid catalyst such as aluminum chloride, boron trifluoride, $SnCl_4$ or the like. A promoted aluminum trichloride or borno trifluoride may be used in one form of the processes disclosed herein. Effective promoters for use with Lewis acids include those well known in the art such as protonic promoters included alcohols, carboxylic acids or water. When using an aluminum chloride catalyst, water is an effective promoter. Generally, the mole ratio of $AlCl_3$ to water added as promoter is between 100 and 0.1 or between 10 and 2. Sometimes, much less water or promoter or even no water or promoter can be used in cases where the olefin feed contains a significant amount of moisture, which acts as a promoter.

The oligomerization may be carried out batch-wise or continuous, neat or in solution. Useful solvents include non-reactive hydrocarbons, such as paraffinic materials including cyclohexane, octane or higher hydrocarbons. The process is carried out under oligomerization conditions comprising temperatures between 0° C. and 250° C. for a time sufficient to produce the synthetic lubricant (five minutes to 50 hours). A wide range of pressures can be used, but typically between 1000 kPa and 35 kPa. The oligomerization may be carried out at atmospheric pressure (102 kPa). Less than 10 weight percent of catalyst may be employed, based on olefin in the feedstock, but higher amounts may be used. In one form, five weight percent of $AlCl_3$ catalyst may be used, based on olefin content.

Following the oligomerization step, the catalyst is removed by washing with dilute acid, base and water and the organic product is separated by distillation to remove components boiling below 400° C. The product recovered has a kinematic viscosity measured at 100° C. between above 1 cS and 300 cS, typically between 3.5 and 300 cS when $AlCl_3$ is used as catalyst, a viscosity index above 100 to 200 and a pour point below −15° C. to less than −60° C.

Metal Oxide Catalysts

The alpha-olefin mixture from thermal cracking of Fischer-Tropsch wax may also be oligomerized by supported metal oxide catalysts, such as Cr compounds on silica or other supported IUPAC Periodic Table Group VIB compounds. In one form, the catalyst may be a lower valence Group VIB metal oxide on an inert support. Although excellent catalytic properties are possessed by the lower valence state of Cr, especially CrII; conversion can be achieved to a lesser degree by reduced tungsten (W) and molybdenum (Mo) compounds. Useful supports include silica, alumina, titania, silica alumina, magnesia and the like. As may be appreciated, the support material binds the metal oxide catalyst. In one form, those porous substrates having a pore opening of at least 40 Angstroms may be employed.

The support material usually has high surface area and large pore volumes, with an average pore size of 40 to 350 (A) angstroms. The high surface area is beneficial for supporting large amounts of highly dispersive, active chromium metal centers and to give maximum efficiency of metal usage, resulting in very high activity catalyst. The support should have large average pore openings of at least 40 angstroms, and has, in one form, an average pore opening of 60 to 300 angstroms. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength may be employed to prevent catalyst particle attrition or disintegration during handling or reaction.

The supported metal oxide catalysts may be prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$, $R_2Mg$, RLi, $R_2Zn$, where R is alkyl, alkoxy, aryl and the like. In one form, CO or $H_2$ or metal alkyl containing compounds may be employed.

Alternatively, the Group VIB metal may be applied to the substrate in reduced form, such as CrII compounds. The resultant catalyst is very active for oligomerizing olefins at a temperature range of 90°-250° C., or 100°-180° C., at autogenous pressure, or 0.1 atmosphere to 5000 psi. Contact time can vary from one second to 24 hours; however, the weight hourly space velocity (WHSV) is 0.1 to 10 based on total catalyst weight. The catalyst can be used in a batch type reactor or in a fixed bed, continuous-flow reactor.

In general, support material may be added to a solution of the metal compounds, e.g., acetates or nitrates, etc., and the mixture is then mixed and dried at room temperature. The dry solid gel is purged at successively higher temperatures to 600° C. for a period of 16 to 20 hours. Thereafter the catalyst is cooled down under an inert atmosphere to a temperature of 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature under a nitrogen atmosphere and is ready for use.

The product recovered from an oligomerization using a supported metal oxide catalyst of the type described herein may have a kinematic viscosity measured at 100° C. of between 6 cS and 5000 cS, with a viscosity index above 100 to 400 and a pour point below 0° C. to less than −60° C. A more complete description of the polymerization process can be found in U.S. Pat. No. 4,827,073, the contents of which are incorporated by reference in their entirety with respect to such details.

Metallocene Catalysts

For the purposes of this disclosure and the claims thereto, the terms "hydrocarbyl radical," "hydrocarbyl," and hydrocarbyl group" are used interchangeably. Likewise the terms "group," "radical," and "substituent" are also used interchangeably. For purposes of this disclosure, "hydrocarbyl radical" is defined to be a $C_1$-$C_{100}$ radical and may be linear, branched, or cyclic. When cyclic, the hydrocarbon radical may be aromatic or non-aromatic. "Hydrocarbon radical" is defined to include substituted hydrocarbyl radicals, halocarbyl radicals, substituted halocarbyl radicals, silylcarbyl radicals, and germylcarbyl radicals as these terms are defined below. Substituted hydrocarbyl radicals are radicals in which at least one hydrogen atom has been substituted with at least one functional group such as $NR^*_2$, $OR^*$, $SeR^*$, $TeR^*$, $PR^*_2$, $AsR^*_2$, $SbR^*_2$, $SR^*$, $BR^*_2$, $SiR^*_3$, $GeR^*_3$, $SnR^*_3$, $PbR^*_3$ and the like or where at least one non-hydrocarbon atom or group has been inserted within the hydrocarbyl radical, such as —O—, —S—, —Se—, —Te—, —N(R*)—, ═N—, —P(R*)—, ═P—, —As(R*)—, ═As—, —Sb(R*)—, ═Sb—, —B(R*)—, ═B—, —Si(R*)$_2$—, —Ge(R*)$_2$—, —Sn(R*)$_2$—, —Pb(R*)$_2$— and the like, where R* is independently a hydrocarbyl or halocarbyl radical, and two or more R* may join together to form a substituted or unsubstituted saturated, partially unsaturated or aromatic cyclic or polycyclic ring structure.

Halocarbyl radicals are radicals in which one or more hydrocarbyl hydrogen atoms have been substituted with at least one halogen (e.g. F, Cl, Br, I) or halogen-containing group (e.g. $CF_3$).

Substituted halocarbyl radicals are radicals in which at least one halocarbyl hydrogen or halogen atom has been substituted with at least one functional group such as $NR^*_2$, $OR^*$, $SeR^*$, $TeR^*$, $PR^*_2$, $AsR^*_2$, $SbR^*_2$, $SR^*$, $BR^*_2$, $SiR^*_3$, $GeR^*_3$, $SnR^*_3$, $PbR^*_3$ and the like or where at least one non-carbon atom or group has been inserted within the halocarbyl radical such as —O—, —S—, —Se—, —Te—, —N(R*)—, ═N—, —P(R*)—, ═P—, —As(R*)—, ═As—, —Sb(R*)—, ═Sb—, —B(R*)—, ═B—, —Si(R*)$_2$—, —Ge(R*)$_2$—, —Sn(R*)$_2$—, —Pb(R*)$_2$— and the like, where R* is independently a hydrocarbyl or halocarbyl radical provided that at least one halogen atom remains on the original halocarbyl radical. Additionally, two or more R* may join together to form a substituted or unsubstituted saturated, partially unsaturated or aromatic cyclic or polycyclic ring structure.

Silylcarbyl radicals (also called silylcarbyls) are groups in which the silyl functionality is bonded directly to the indicated atom or atoms. Examples include $SiH_3$, $SiH_2R^*$, $SiHR^*_2$, $SiR^*_3$, $SiH_2(OR^*)$, $SiH(OR^*)_2$, $Si(OR^*)_3$, $SiH_2(NR^*_2)$, $SiH(NR^*_2)_2$, $Si(NR^*_2)_3$, and the like where R* is independently a hydrocarbyl or halocarbyl radical and two or more R* may join together to form a substituted or unsubstituted saturated, partially unsaturated or aromatic cyclic or polycyclic ring structure.

Germylcarbyl radicals (also called germylcarbyls) are groups in which the germyl functionality is bonded directly to the indicated atom or atoms. Examples include $GeH_3$, $GeH_2R^*$, $GeHR^*_2$, $GeR^5_3$, $GeH_2(OR^*)$, $GeH(OR^*)_2$, $Ge(OR^*)_3$, $GeH_2(NR^*_2)$, $GeH(NR^*_2)_2$, $Ge(NR^*_2)_3$, and the like where R* is independently a hydrocarbyl or halocarbyl radical and two or more R* may join together to form a substituted or unsubstituted saturated, partially unsaturated or aromatic cyclic or polycyclic ring structure.

Polar radicals or polar groups are groups in which heteroatom functionality is bonded directly to the indicated atom or atoms. They include heteroatoms of groups 1-17 of the periodic table (except carbon and hydrogen) either alone or connected to other elements by covalent bonds or other interactions such as ionic bonds, van der Waals forces, or hydrogen bonding. Examples of functional heteroatom containing groups include carboxylic acids, acid halides, carboxylic esters, carboxylic salts, carboxylic anhydrides, aldehydes and their chalcogen (Group 14) analogues, alcohols and phenols, ethers, peroxides and hydroperoxides, carboxylic amides, hydrazides and imides, amidines and other nitrogen analogues of amides, nitriles, amines and imines, azos, nitros, other nitrogen compounds, sulfur acids, selenium acids, thiols, sulfides, sulfoxides, sulfones, phosphines, phosphates, other phosphorus compounds, silanes, boranes, borates, alanes, aluminates. Functional groups may also be taken broadly to include organic polymer supports or inorganic support material such as alumina, and silica. In one form, the polar groups may include $NR^*_2$, OR*, SeR*, TeR*, $PR^*_2$, $AsR^*_2$, $SbR^*_2$, SR*, $BR^*_2$, $SnR^*_3$, $PbR^*_3$ and the like where R* is independently a hydrocarbyl, substituted hydrocarbyl, halocarbyl or substituted halocarbyl radical as defined above and two R* may join together to form a substituted or unsubstituted saturated, partially unsaturated or aromatic cyclic or polycyclic ring structure.

In using the terms "substituted or unsubstituted cyclopentadienyl ligand", "substituted or unsubstituted indenyl ligand", and "substituted or unsubstituted tetrahydroindenyl ligand", the substitution to the aforementioned ligand may be hydrocarbyl, substituted hydrocarbyl, halocarbyl, substituted halocarbyl, silylcarbyl, or germylcarbyl. The substitution may also be within the ring giving heterocyclopentadienyl ligands, heteroindenyl ligands or heterotetrahydroindenyl ligands, each of which can additionally be substituted or unsubstituted.

In some forms, the hydrocarbyl radical is independently selected from methyl, ethyl, ethenyl, and isomers of propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, triacontyl, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, triacontenyl, propynyl, butynyl, pentynyl, hexynyl, heptynyl, octynyl, nonynyl, decynyl, undecynyl, dodecynyl, tridecynyl, tetradecynyl, pentadecynyl, hexadecynyl, heptadecynyl, octadecynyl, nonadecynyl, eicosynyl, heneicosynyl, docosynyl, tricosynyl, tetracosynyl, pentacosynyl, hexacosynyl, heptacosynyl, octacosynyl, nonacosynyl, triacontynyl, butadienyl, pentadienyl, hexadienyl, heptadienyl, octadienyl, nonadienyl, and decadienyl. Also included are isomers of saturated, partially unsaturated and aromatic cyclic and polycyclic structures wherein the radical may additionally be subjected to the types of substitutions described above. Examples include phenyl, methylphenyl, dimethylphenyl, ethylphenyl, diethylphenyl, propylphenyl, dipropylphenyl, benzyl, methylbenzyl, naphthyl, anthracenyl, cyclopentyl, cyclopentenyl, cyclohexyl, cyclohexenyl, methylcyclohexyl, cycloheptyl, cycloheptenyl, norbornyl, norbornenyl, adamantyl and the like.

For this disclosure, when a radical is listed, it indicates that radical type and all other radicals formed when that radical type is subjected to the substitutions defined above. Alkyl, alkenyl and alkynyl radicals listed include all isomers including where appropriate cyclic isomers, for example, butyl includes n-butyl, 2-methylpropyl, 1-methylpropyl, tert-butyl, and cyclobutyl (and analogous substituted cyclopropyls); pentyl includes n-pentyl, cyclopentyl, 1-methylbutyl, 2-methylbutyl, 3-methylbutyl, 1-ethylpropyl, and neopentyl (and analogous substituted cyclobutyls and cyclopropyls); butenyl includes E and Z forms of 1-butenyl, 2-butenyl, 3-butenyl, 1-methyl-1-propenyl, 1-methyl-2-propenyl, 2-methyl-1-propenyl and 2-methyl-2-propenyl (and cyclobutenyls and cyclopropenyls). Cyclic compound having substitutions include all isomer forms, for example, methylphenyl would include ortho-methylphenyl, meta-methylphenyl and para-methylphenyl; dimethylphenyl would include 2,3-dimethylphenyl, 2,4-dimethylphenyl, 2,5-dimethylphenyl, 2,6-diphenylmethyl, 3,4-dimethylphenyl, and 3,5-dimethylphenyl. Examples of cyclopentadienyl and indenyl ligands are illustrated below as anionic ligands. The ring numbering scheme is also illustrated.

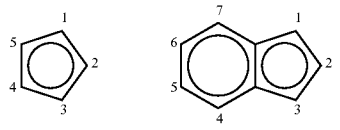

Cyclopentadienyl Indenyl

A similar numbering and nomenclature scheme is used for heteroindenyl as illustrated below where Z and Q independently represent the heteroatoms O, S, Se, or Te, or heteroatom groups, NR', PR', AsR', or SbR' where R' is hydrogen, or a hydrocarbyl, substituted hydrocarbyl, halocarbyl, substituted halocarbyl, silylcarbyl, or germylcarbyl substituent. The number scheme shown below is for heteroindenyl ligands that are bridged to another ligand via a bridging group.

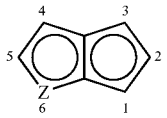

Examples include:
Cyclopenta[b]thienyl (Z = S)
Cyclopenta[b]furanyl (Z = O)
Cyclopenta[b]selenophenyl (Z =Se)
Cyclopenta[b]tellurophenyl (Z = Te)
6-Methyl-cyclopenta[b]pyrrolyl (Z = N—Me)
6-Methyl-cyclopenta[b]phospholyl (Z = P—Me)
6-Methyl-cyclopenta[b]arsolyl (Z = As—Me)
6-Methyl-cyclopenta[b]stibolyl (Z = Sb—Me)

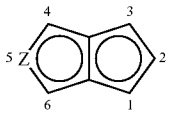

Examples include:
Cyclopenta[c]thienyl (Z = S)
Cyclopenta[c]furanyl (Z = O)
Cyclopenta[c]selenophenyl (Z =Se)
Cyclopenta[c]tellurophenyl (Z = Te)
5-Methyl-cyclopenta[c]pyrrolyl (Z = N—Me)
5-Methyl-cyclopenta[c]phospholyl (Z = P—Me)
5-Methyl-cyclopenta[c]arsolyl (Z = As—Me)
5-Methyl-cyclopenta[c]stibolyl (Z = Sb—Me)

A similar numbering and nomenclature scheme is used for heterocyclopentadienyl rings as illustrated below where G and J independently represent the heteroatoms N, P, As, Sb or B. For these ligands when bridged to another ligand via a bridging group, the one position is usually chosen to be the ring carbon position where the ligand is bonded to the bridging group, hence a numbering scheme is not illustrated below.

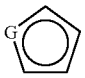

Examples include:
Azacyclopentadiene (G = N)
Phosphacyclopentadiene (G = P)
Stibacyclopentadiene (G = Sb)
Arascyclopentadiene (G = As)
Boracyclopentadiene (G = B)

Depending on the position of the bridging ligand, the numbering for the following ligands will change; 1,3 and 1,2 are only used in this case to illustrate the position of the heteroatoms relative to one another.

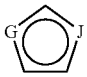

Examples include:
1,3-Diazacyclopentadiene (G = J = N)
1,3-Diphosphacyclopentadiene (G = J = P)
1,3-Distibacyclopentadiene (G = J = Sb)
1,3-Diarsacyclopentadiene (G = J = As)
1,3-Diboracyclopentadiene (G = J = B)
1,3-Azaphosphacyclopentadiene (G = N; J = P)
1,3-Azastibacyclopentadiene (G = N; J = Sb)
1,3-Azarsacyclopentadiene (G = N; J = As)
1,3-Azaboracyclopentadience (G = N; J = B)
1,3-Arsaphosphacyclopentadiene (G = As; J = P)
1,3-Arsastibacyclopentadiene (G = As; J = Sb)
1,3-Arsaboracyclopentadiene (G = As; J = B)
1,3-Boraphosphacyclopentadiene (G = B; J = P)
1,3-Borastibacyclolpentadiene (G = B; J = Sb)
1,3-Phosphastibacyclopentadiene (G = P; J = Sb)

-continued

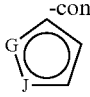

Examples include:
1,2-Diazacyclopentadiene (G = J = N)
1,2-Diphosphacyclopentadiene (G = J = P)
1,2-Distibacyclopentadiene (G = J = Sb)
1,2-Diarsacyclopentadiene (G = J = As)
1,2-Diboracyclopentadiene (G = J = B)
1,2-Azaphosphacyclopentadiene (G = N; J = P)
1,2-Azastibacyclopentadiene (G = N; J = Sb)
1,2-Azarsacyclopentadiene (G = N; J = As)
1,2-Azaboracyclopentadience (G = N; J = B)
1,2-Arsaphosphacyclopentadiene (G = As; J = P)
1,2-Arsastibacyclopentadiene (G = As; J = Sb)
1,2-Arsaboracyclopentadiene (G = As; J = B)
1,2-Boraphosphacyclopentadiene (G = B; J = P)
1,2-Borastibacyclolpentadiene (G = B; J = Sb)
1,2-Phosphastibacyclopentadiene (G = P; J = Sb)

A "ring heteroatom" is a heteroatom that is within a cyclic ring structure. A "heteroatom substituent" is heteroatom containing group that is directly bonded to a ring structure through the heteroatom. A "bridging heteroatom substituent" is a heteroatom or heteroatom group that is directly bonded to two different ring structures through the heteroatom. The terms "ring heteroatom", "heteroatom substituent", and "bridging heteroatom substituent" are illustrated below where Z and R' are as defined above. It should be noted that a "heteroatom substituent" can be a "bridging heteroatom substituent" when R' is additionally defined as the ligand "A".

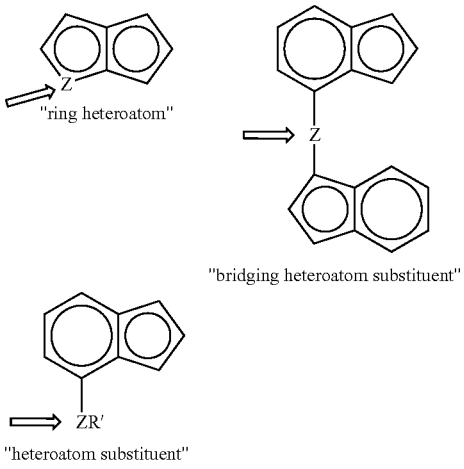

A "ring carbon atom" is a carbon atom that is part of a cyclic ring structure. By this definition, an indenyl ligand has nine ring carbon atoms; a cyclopentadienyl ligand has five ring carbon atoms.

Transition metal compounds have symmetry elements and belong to symmetry groups. These elements and groups are well established and can be referenced from Chemical Applications of Group Theory (2nd Edition) by F. Albert Cotton, Wiley-Interscience, 1971. Pseudo-symmetry, such as a pseudo $C_2$-axis of symmetry refers to the same symmetry operation, however, the substituents on the ligand frame do not need to be identical, but of similar size and steric bulk. Substituents of similar size are typically within 4 atoms of each other, and of similar shape. For example, methyl, ethyl, n-propyl, n-butyl and iso-butyl substituents (e.g. $C_1$-$C_4$ primary bonded substituents) would be considered of similar size and steric bulk. Likewise, iso-propyl, sec-butyl, 1-methylbutyl, 1-ethylbutyl and 1-methylpentyl substituents (e.g. $C_3$-$C_6$ secondary bonded substituents) would be considered of similar size and steric bulk. Tert-butyl, 1,1-dimethylpropyl, 1,1-dimethylbutyl, 1,1-dimethylpentyl and 1-ethyl-1-methylpropyl (e.g. $C_4$-$C_7$ tertiary bonded substituents) would be considered of similar size and steric bulk. Phenyl, tolyl, xylyl, and mesityl substituents ($C_6$-$C_9$ aryl substituents) would be considered of similar size and steric bulk. Additionally, the bridging substituents of a compound with a pseudo $C_2$-axis of symmetry do not have to be similar at all since they are far removed from the active site of the catalyst. Therefore, a compound with a pseudo $C_2$-axis of symmetry could have for example, a $Me_2Si$, MeEtSi or MePhSi bridging ligand, and still be considered to have a pseudo $C_2$-axis of symmetry given the appropriate remaining ligand structure. In some forms, metallocenes with a $C_1$-axis of symmetry may also be useful herein.

For purposes of this disclosure, the term oligomer refers to compositions having 2-75 mer units and the term polymer refers to compositions having 76 or more mer units. A mer is defined as a unit of an oligomer or polymer that originally corresponded to the olefin(s) used in the oligomerization or polymerization reaction. For example, the mer of polydecene would be decene.

The metallocene catalyst system usually contains several components: the metallocene compounds (pre-catalysts), an activator and a co-activator. The reaction system sometimes also contains a scavenger to scavenge any impurity that may reduce the catalyst productivity. In many practices, the co-activator also performs as a scavenger. As used herein, the metallocene compounds can be any type of metallocene compounds, commonly known as unbridged metallocene, racemic metallocenes, meso-metallocenes or metallocenes with different symmetry groups, C2, C2v, Cs, C1 etc. A detailed discussion of the metallocenes can be found in the paper, Chemical Review, 2000, vol. 100, page 1253-1345 by L. Resconi, etc. As used herein, the activator can be alkylaluminoxane or modified version, such as methylaluminoxane (MAO) or modified methylaluminoxane. The activator can also be any of ionic or neutral compounds that can provide a non-coordinating anionic (NCA) for the active catalyst system as described below. The co-activator can react with the metallocene compounds to promote its activation with the MAO or NCA type activators. The co-activators can also act as scavenger for the reactor system.

The metallocene compounds (pre-catalysts) useful herein include cyclopentadienyl derivatives of titanium, zirconium and hafnium. In general, useful titanocenes, zirconocenes and hafnocenes may be represented by the following formulae:

$$(Cp\text{-}A'\text{-}Cp^*)MX_1X_2 \quad (1)$$

$$(CpCp^*)MX_1X_2 \quad (2)$$

wherein:

M is the metal center, and is a Group 4 metal such as titanium, zirconium or hafnium, zirconium or hafnium;

Cp and Cp* are the same or different cyclopentadienyl rings that are each bonded to M, and substituted with from zero to four substituent groups S" for formula (1) and zero to five substituents for formula (2), each substituent group S" being, independently, a radical group which is a hydrocarbyl, substituted hydrocarbyl, halocarbyl, substituted halocarbyl, silylcarbyl or germylcarbyl, or Cp and Cp* are the same or different cyclopentadienyl rings in which any two adjacent S" groups are optionally joined to form a substituted or unsubstituted, saturated, partially unsaturated, or aromatic cyclic or polycyclic substituent; A' is a bridging group;

$X_1$ and $X_2$ are, independently, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both X are joined and bound to the metal atom to form a metallacycle ring containing from 3 to 20 carbon atoms; or both together can be an olefin, diolefin or aryne ligand; or when Lewis-acid activators, such as methylalumoxane, which are capable of donating an X ligand as described above to the transition metal component are used, both X may, independently, be a halogen, alkoxide, aryloxide, amide, phosphide or other univalent anionic ligand or both X can also be joined to form a anionic chelating ligand.

In one form, the metallocene is racemic, which means that the compounds represented by formula (1) [(Cp-A'-Cp*)$MX_1X_2$] have no plane of symmetry containing the metal center, M; and have a $C_2$-axis of symmetry or pseudo $C_2$-axis of symmetry through the metal center. In the racemic metallocenes represented by formula (1) A' may be selected from $R'_2C$, $R'_2Si$, $R'_2Ge$, $R'_2CCR'_2$, $R'_2CCR'_2CR'_2$, $R'_2CCR'_2CR'_2CR'_2$, R'C═CR', $R'C{=}CR'CR'_2$, $R'_2CCR'{=}CR'CR'_2$, $R'C{=}CR'CR'{=}CR'$, $R'C{=}CR'CR'_2CR'_2$, $R'_2CSiR'_2$, $R'_2SiSiR'_2$, $R'_2CSiR'_2CR'_2$, $R'_2SiCR'_2SiR'_2$, $R'C{=}CR'SiR'_2$, $R'_2CGeR'_2$, $R'_2GeGeR'_2$, $R'_2CGeR'_2CR'_2$, $R'_2GeCR'_2GeR'_2$, $R'_2SiGeR'_2$, $R'C{=}CR'GeR'_2$, R'B, $R'_2C{-}BR'$, $R'_2C{-}BR'{-}CR'_2$, R'N, R'P, O, S, Se, $R'_2C{-}O{-}CR'_2$, $R'_2CR'_2C{-}O{-}CR'_2CR'_2$, $R'_2C{-}O{-}CR'_2CR'_2$, $R'_2C{-}O{-}CR'{=}CR'$, $R'_2C{-}S{-}CR'_2$, $R'_2CR'_2C{-}S{-}CR'_2CR'_2$, $R'_2C{-}S{-}CR'_2CR'_2$, $R'_2C{-}S{-}CR'{=}CR'$, $R'_2C{-}Se{-}CR'_2$, $R'_2CR'_2C{-}Se{-}CR'_2CR'_2$, $R'_2C{-}Se{-}CR'_2CR'_2$, $R'_2C{-}Se{-}CR'{=}CR'$, $R'_2C{-}N{=}CR'$, $R'_2C{-}NR'{-}CR'_2$, $R'_2C{-}NR'{-}CR'_2CR'_2$, $R'_2C{-}NR'{-}CR'{=}CR'$, $R'_2CR'_2C{-}NR'{-}CR'_2CR'_2$, $R'_2C{-}P{=}CR'$, and $R'_2C{-}PR'{-}CR'_2$ where when Cp is different than Cp* then R' is a C1-C5 containing hydrocarbyl, substituted hydrocarbyl, halocarbyl, substituted halocarbyl, silylcarbyl or germylcarbyl substituent, and when Cp is the same as Cp* then R' is selected from hydrogen, $C_1$-$C_{20}$ containing hydrocarbyl, substituted hydrocarbyl, halocarbyl, substituted halocarbyl, silylcarbyl or germylcarbyl substituent and optionally two or more adjacent R' may join to form a substituted or unsubstituted, saturated, partially unsaturated, cyclic or polycyclic substituent.

Table A depicts representative constituent moieties for the metallocene components of formula 1 and 2. The list is for illustrative purposes only and should not be construed to be limiting in any way. A number of final components may be formed by permuting all possible combinations of the constituent moieties with each other. When hydrocarbyl radicals including alkyl, alkenyl, alkynyl, cycloalkyl, cycloalkenyl, cycloalkynyl and aromatic radicals are disclosed in this application the term includes all isomers. For example, butyl includes n-butyl, 2-methylpropyl, 1-methylpropyl, tert-butyl, and cyclobutyl; pentyl includes n-pentyl, 1-methylbutyl, 2-methylbutyl, 3-methylbutyl, 1-ethylpropyl, neopentyl, cyclopentyl and methylcyclobutyl; butenyl includes E and Z forms of 1-butenyl, 2-butenyl, 3-butenyl, 1-methyl-1-propenyl, 1-methyl-2-propenyl, 2-methyl-1-propenyl and 2-methyl-2-propenyl. This includes when a radical is bonded to another group, for example, propylcyclopentadienyl include n-propylcyclopentadienyl, isopropylcyclopentadienyl and cyclopropylcyclopentadienyl. In general, the ligands or groups illustrated in Table A include all isomeric forms. For example, dimethylcyclopentadienyl includes 1,2-dimethylcyclopentadienyl and 1,3-dimethylcyclopentadienyl; methylindenyl includes 1-methylindenyl, 2-methylindenyl, 3-methylindenyl, 4-methylindenyl, 5-methylindenyl, 6-methylindenyl and 7-methylindenyl; methylethylphenyl includes ortho-methylethylphenyl, meta-methylethylphenyl and para-methylethylphenyl.

Examples of specific catalyst precursors take the following formula where some components are listed in Table A. To illustrate members of the transition metal component, select any combination of the species listed in Tables A. For nomenclature purposes, for the bridging group, A', the words "silyl" and "silylene" are used interchangeably, and represent a diradical species. For the bridging group A', "ethylene" refers to a 1,2-ethylene linkage and is distinguished from ethene-1,1-diyl. Thus, for the bridging group A', "ethylene" and "1,2-ethylene" are used interchangeably. For compounds having a bridging group, A', the bridge position on the cyclopentadienyl-type ring is always considered the 1-position. The numbering scheme previous defined for the indenyl ring is used to indicate the bridge position; if a number is not specified, it is assumed that the bridge to the indenyl ligand is in the one position.

TABLE A

| A' |
|---|
| dimethylsilylene |
| diethylsilylene |
| dipropylsilylene |
| dibutylsilylene |
| dipentylsilylene |
| dihexylsilylene |
| diheptylsilylene |
| dioctylsilylene |
| dinonylsilylene |
| didecylsilylene |
| diundecylsilylene |
| didodecylsilylene |
| ditridecylsilylene |
| ditetradecylsilylene |
| dipentadecylsilylene |
| dihexadecylsilylene |
| diheptadecylsilylene |
| dioctadecylsilylene |
| dinonadecylsilylene |
| dieicosylsilylene |
| diheneicosylsilylene |
| didocosylsilylene |
| ditricosylsilylene |
| ditetracosylsilylene |
| dipentacosylsilylene |
| dihexacosylsilylene |
| diheptacosylsilylene |
| dioctacosylsilylene |
| dinonacosylsilylene |
| ditriacontylsilylene |
| dicyclohexylsilylene |
| dicyclopentylsilylene |
| dicycloheptylsilylene |
| dicyclooctylsilylene |
| dicyclodecylsilylene |
| dicyclododecylsilylene |
| dinapthylsilylene |
| diphenylsilylene |
| ditolylsilylene |
| dibenzylsilylene |
| diphenethylsilylene |
| di(butylphenethyl)silylene |
| methylethylsilylene |
| methylpropylsilylene |
| methylbutylsilylene |
| methylhexylsilylene |
| methylphenylsilylene |
| ethylphenylsilylene |
| ethylpropylsilylene |
| ethylbutylsilylene |
| propylphenylsilylene |
| dimethylgermylene |

TABLE A-continued

| |
|---|
| diethylgermylene |
| diphenylgermylene |
| methylphenylgermylene |
| cyclotetramethylenesilylene |
| cyclopentamethylenesilylene |
| cyclotrimethylenesilylene |
| cyclohexylazanediyl |
| butylazanediyl |
| methylazanediyl |
| phenylazanediyl |
| perfluorophenylazanediyl |
| methylphosphanediyl |
| ethylphosphanediyl |
| propylphosphanediyl |
| butylphosphanediyl |
| cyclohexylphosphanediyl |
| phenylphosphanediyl |
| methylboranediyl |
| phenylboranediyl |
| methylene |
| dimethylmethylene |
| diethylmethylene |
| dibutylmethylene |
| dipropylmethylene |
| diphenylmethylene |
| ditolylmethylene |
| di(butylphenyl)methylene |
| di(trimethylsilylphenyl)methylene |
| di(triethylsilylphenyl)methylene |
| dibenzylmethylene |
| cyclotetramethylenemethylene |
| cyclopentamethylenemethylene |
| ethylene |
| methylethylene |
| dimethylethylene |
| trimethylethylene |
| tetramethylethylene |
| cyclopentylene |
| cyclohexylene |
| cycloheptylene |
| cyclooctylene |
| propanediyl |
| methylpropanediyl |
| dimethylpropanediyl |
| trimethylpropanediyl |
| tetramethylpropanediyl |
| Pentamethylpropanediyl |
| Hexamethylpropanediyl |
| Tetramethyldisiloxylene |
| Vinylene |
| ethene-1,1-diyl |
| Divinylsilylene |
| Dipropenylsilylene |
| Dibutenylsilylene |
| Methylvinylsilylene |
| Methylpropenylsilylene |
| Methylbutenylsilylene |
| Dimethylsilylmethylene |
| Diphenylsilylmethylene |
| Dimethylsilylethylene |
| Diphenylsilylethylene |
| Dimethylsilylpropylene |
| Diphenylsilylpropylene |
| Dimethylstannylene |
| Diphenylstannylene |
| $X_1$ or $X_2$ |
| Chloride |
| Bromide |
| Iodide |
| Fluoride |
| Hydride |
| Methyl |
| Ethyl |
| Propyl |
| Butyl |
| Pentyl |
| Hexyl |
| Heptyl |
| Octyl |

TABLE A-continued

| |
|---|
| Nonyl |
| Decyl |
| Undecyl |
| Dodecyl |
| Tridecyl |
| Tetradecyl |
| Pentadecyl |
| Hexadecyl |
| Heptadecyl |
| Octadecyl |
| Nonadecyl |
| Eicosyl |
| Heneicosyl |
| Docosyl |
| Tricosyl |
| Tetracosyl |
| Pentacosyl |
| Hexacosyl |
| Heptacosyl |
| Octacosyl |
| Nonacosyl |
| Triacontyl |
| Phenyl |
| Benzyl |
| Phenethyl |
| Tolyl |
| Methoxy |
| Ethoxyy |
| Propoxy |
| Butoxy |
| Dimethylamido |
| Diethylamido |
| Methylethylamido |
| Phenoxy |
| Benzoxy |
| Allyl |
| $X_1$ and $X_2$ together |
| Methylidene |
| Ethylidene |
| Propylidene |
| Tetramethylene |
| Pentamethylene |
| Hexamethylene |
| Ethylenedihydroxy |
| Butadiene |
| Methylbutadiene |
| Dimethylbutadiene |
| Pentadiene |
| Methylpentadiene |
| Dimethylpentadiene |
| Hexadiene |
| methylhexadiene |
| dimethylhexadiene |
| titanium |
| zirconium |
| hafnium |
| Cp, Cp* |
| Cyclopentadienyl |
| methylcyclopentadienyl |
| dimethylcyclopentadienyl |
| trimethylcyclopentadienyl |
| tetramethylcyclopentadienyl |
| Ethylcyclopentadienyl |
| Diethylcyclopentadienyl |
| Propylcyclopentadienyl |
| Dipropylcyclopentadienyl |
| Butylcyclopentadienyl |
| Dibutylcyclopentadienyl |
| Pentylcyclopentadienyl |
| Dipentylcyclopentadienyl |
| Hexylcyclopentadienyl |
| Dihexylcyclopentadienyl |
| Heptylcyclopentadienyl |
| Diheptylcyclopentadienyl |
| Octylcyclopentadienyl |
| Dioctylcyclopentadienyl |
| Nonylcyclopentadienyl |
| Dinonylcyclopentadienyl |

TABLE A-continued

| |
|---|
| Decylcyclopentadienyl |
| Didecylcyclopentadienyl |
| Undecylcyclopentadienyl |
| Dodecylcyclopentadienyl |
| Tridecylcyclopentadienyl |
| tetradecylcyclopentadienyl |
| pentadecylcyclopentadienyl |
| hexadecylcyclopentadienyl |
| heptadecylcyclopentadienyl |
| octadecylcyclopentadienyl |
| nonadecylcyclopentadienyl |
| Eicosylcyclopentadienyl |
| heneicosylcyclopentadienyl |
| Docosylcyclopentadienyl |
| Tricosylcyclopentadienyl |
| tetracosylcyclopentadienyl |
| pentacosylcyclopentadienyl |
| hexacosylcyclopentadienyl |
| heptacosylcyclopentadienyl |
| octacosylcyclopentadienyl |
| nonacosylcyclopentadienyl |
| triacontylcyclopentadienyl |
| cyclohexylcyclopentadienyl |
| Phenylcyclopentadienyl |
| diphenylcyclopentadienyl |
| triphenylcyclopentadienyl |
| tetraphenylcyclopentadienyl |
| Tolylcyclopentadienyl |
| Benzylcyclopentadienyl |
| phenethylcyclopentadienyl |
| cyclohexylmethylcyclopentadienyl |
| Napthylcyclopentadienyl |
| methylphenylcyclopentadienyl |
| methyltolylcyclopentadienyl |
| methylethylcyclopentadienyl |
| methylpropylcyclopentadienyl |
| methylbutylcyclopentadienyl |
| methylpentylcyclopentadienyl |
| methylhexylcyclopentadienyl |
| methylheptylcyclpentadienyl |
| methyloctylcyclopentadienyl |
| methylnonylcyclopentadienyl |
| methyldecylcyclopentadienyl |
| Vinylcyclopentadienyl |
| propenylcyclopentadienyl |
| Butenylcyclopentadienyl |
| Indenyl |
| Methylindenyl |
| Dimethylindenyl |
| Trimethylindenyl |
| Tetramethylindenyl |
| Pentamethylindenyl |
| Methylpropylindenyl |
| Dimethylpropylindenyl |
| Methyldipropylindenyl |
| Methylethylindenyl |
| Methylbutylindenyl |
| Ethylindenyl |
| Propylindenyl |
| Butylindenyl |
| Pentylindenyl |
| Hexylindenyl |
| Heptylindenyl |
| Octylindenyl |
| Nonylindenyl |
| Decylindenyl |
| Phenylindenyl |
| (fluorophenyl)indenyl |
| (methylphenyl)indenyl |
| Biphenylindenyl |
| (bis(trifluoromethyl)phenyl)indenyl |
| Napthylindenyl |
| Phenanthrylindenyl |
| Benzylindenyl |
| Benzindenyl |
| Cyclohexylindenyl |
| Methylphenylindenyl |
| Ethylphenylindenyl |
| Propylphenylindenyl |
| Methylnapthylindenyl |

TABLE A-continued

Ethylnapthylindenyl
Propylnapthylindenyl
(methylphenyl)indenyl
(dimethylphenyl)indenyl
(ethylphenyl)indenyl
(diethylphenyl)indenyl
(propylphenyl)indenyl
(dipropylphenyl)indenyl
Methyltetrahydroindenyl
Ethyltetrahydroindenyl
Propyltetrahydroindenyl
Butyltetrahydroindenyl
Phenyltetrahydroindenyl
(diphenylmethyl)cyclopentadienyl
trimethylsilylcyclopentadienyl
triethylsilylcyclopentadienyl
trimethylgermylcyclopentadienyl
trifluromethylcyclopentadienyl
cyclopenta[b]thienyl
cyclopenta[b]furanyl
cyclopenta[b]selenophenyl
cyclopenta[b]tellurophenyl
cyclopenta[b]pyrrolyl
cyclopenta[b]phospholyl
cyclopenta[b]arsolyl
cyclopenta[b]stibolyl
methylcyclopenta[b]thienyl
methylcyclopenta[b]furanyl
methylcyclopenta[b]selenophenyl
methylcyclopenta[b]tellurophenyl
methylcyclopenta[b]pyrrolyl
methylcyclopenta[b]phospholyl
methylcyclopenta[b]arsolyl
methylcyclopenta[b]stibolyl
dimethylcyclopenta[b]thienyl
dimethylcyclopenta[b]furanyl
dimethylcyclopenta[b]pyrrolyl
dimethylcyclopenta[b]phospholyl
trimethylcyclopenta[b]thienyl
trimethylcyclopenta[b]furanyl
trimethylcyclopenta[b]pyrrolyl
trimethylcyclopenta[b]phospholyl
ethylcyclopenta[b]thienyl
ethylcyclopenta[b]furanyl
ethylcyclopenta[b]pyrrolyl
ethylcyclopenta[b]phospholyl
diethylcyclopenta[b]thienyl
diethylcyclopenta[b]furanyl
diethylcyclopenta[b]pyrrolyl
diethylcyclopenta[b]phospholyl
triethylcyclopenta[b]thienyl
triethylcyclopenta[b]furanyl
triethylcyclopenta[b]pyrrolyl
triethylcyclopenta[b]phospholyl
propylcyclopenta[b]thienyl
propylcyclopenta[b]furanyl
propylcyclopenta[b]pyrrolyl
propylcyclopenta[b]phospholyl
dipropylcyclopenta[b]thienyl
dipropylcyclopenta[b]furanyl
dipropylcyclopenta[b]pyrrolyl
dipropylcyclopenta[b]phospholyl
tripropylcyclopenta[b]thienyl
tripropylcyclopenta[b]furanyl
tripropylcyclopenta[b]pyrrolyl
tripropylcyclopenta[b]phospholyl
butylcyclopenta[b]thienyl
butylcyclopenta[b]furanyl
butylcyclopenta[b]pyrrolyl
butylcyclopenta[b]phospholyl
dibutylcyclopenta[b]thienyl
dibutylcyclopenta[b]furanyl
dibutylcyclopenta[b]pyrrolyl
dibutylcyclopenta[b]phospholyl
tributylcyclopenta[b]thienyl
tributylcyclopenta[b]furanyl
tributylcyclopenta[b]pyrrolyl
tributylcyclopenta[b]phospholyl
ethylmethylcyclopenta[b]thienyl
ethylmethylcyclopenta[b]furanyl TABLE A-continued ethylmethylcyclopenta[b]pyrrolyl
ethylmethylcyclopenta[b]phospholyl
methylpropylcyclopenta[b]thienyl
methylpropylcyclopenta[b]furanyl
methylpropylcyclopenta[b]pyrrolyl
methylpropylcyclopenta[b]phospholyl
butylmethylcyclopenta[b]thienyl
butylmethylcyclopenta[b]furanyl
butylmethylcyclopenta[b]pyrrolyl
butylmethylcyclopenta[b]phospholyl
cyclopenta[c]thienyl
cyclopenta[c]furanyl
cyclopenta[c]selenophenyl
cyclopenta[c]tellurophenyl
cyclopenta[c]pyrrolyl
cyclopenta[c]phospholyl
cyclopenta[c]arsolyl
cyclopenta[c]stibolyl
methylcyclopenta[c]thienyl
methylcyclopenta[c]furanyl
methylcyclopenta[c]selenophenyl
methylcyclopenta[c]tellurophenyl
methylcyclopenta[c]pyrrolyl
methylcyclopenta[c]phospholyl
methylcyclopenta[c]arsolyl
methylcyclopenta[c]stibolyl
dimethylcyclopenta[c]thienyl
dimethylcyclopenta[c]furanyl
dimethylcyclopenta[c]pyrrolyl
dimethylcyclopenta[c]phospholyl
trimethylcyclopenta[c]thienyl
trimethylcyclopenta[c]furanyl
trimethylcyclopenta[c]pyrrolyl
trimethylcyclopenta[c]phospholyl
ethylcyclopenta[c]thienyl
ethylcyclopenta[c]furanyl
ethylcyclopenta[c]pyrrolyl
ethylcyclopenta[c]phospholyl
diethylcyclopenta[c]thienyl
diethylcyclopenta[c]furanyl
diethylcyclopenta[c]pyrrolyl
diethylcyclopenta[c]phospholyl
triethylcyclopenta[c]thienyl
triethylcyclopenta[c]furanyl
triethylcyclopenta[c]pyrrolyl
triethylcyclopenta[c]phospholyl
propylcyclopenta[c]thienyl
propylcyclopenta[c]furanyl
propylcyclopenta[c]pyrrolyl
propylcyclopenta[c]phospholyl
dipropylcyclopenta[c]thienyl
dipropylcyclopenta[c]furanyl
dipropylcyclopenta[c]pyrrolyl
dipropylcyclopenta[c]phospholyl
tripropylcyclopenta[c]thienyl
tripropylcyclopenta[c]furanyl
tripropylcyclopenta[c]pyrrolyl
tripropylcyclopenta[c]phospholyl
butylcyclopenta[c]thienyl
butylcyclopenta[c]furanyl
butylcyclopenta[c]pyrrolyl
butylcyclopenta[c]phospholyl
dibutylcyclopenta[c]thienyl
dibutylcyclopenta[c]furanyl
dibutylcyclopenta[c]pyrrolyl
dibutylcyclopenta[c]phospholyl
tributylcyclopenta[c]thienyl
tributylcyclopenta[c]furanyl
tributylcyclopenta[c]pyrrolyl
tributylcyclopenta[c]phospholyl
ethylmethylcyclopenta[c]thienyl
ethylmethylcyclopenta[c]furanyl
ethylmethylcyclopenta[c]pyrrolyl
ethylmethylcyclopenta[c]phospholyl
methylpropylcyclopenta[c]thienyl
methylpropylcyclopenta[c]furanyl
methylpropylcyclopenta[c]pyrrolyl
methylpropylcyclopenta[c]phospholyl
butylmethylcyclopenta[c]thienyl
butylmethylcyclopenta[c]furanyl TABLE A-continued

| |
|---|
| butylmethylcyclopenta[c]pyrrolyl |
| butylmethylcyclopenta[c]phospholyl |
| pentamethylcyclopentadienyl |
| Tetrahydroindenyl |
| Mehtyltetrahydroindenyl |
| dimethyltetrahydroindenyl |

In one form, Cp is the same as Cp* and is a substituted or unsubstituted indenyl or tetrahydroindenyl ligand. In another form, substituted indenyl or tetrahydroindenyl ligands do not have a substituent in the 2-position of the indenyl or tetrahydroindenyl ring. In yet another form, substituted and unsubstituted indenyl or tetrahydroindenyl ligands include indenyl, tetrahydroindenyl, 4,7-dimethylindenyl and 5,6-dimethylindenyl.

In one form, when used with an NCA, Cp is the same as Cp* and is a substituted or unsubstituted indenyl or tetrahydroindenyl ligand. In another form, substituted and unsubstituted indenyl or tetrahydroindenyl ligands include a substituent in the 2-position of the indenyl or tetrahydroindenyl ring, indenyl, tetrahydroindenyl, 4,7-dimethylindenyl and 5,6-dimethylindenyl.

In another form, when used with NCA, the metallocene catalyst compound used herein is bridged, substituted or unsubstituted metallocenes of general structure as shown in formula (1) or (2)

In one form, the catalyst used herein is $Y_2$methylidene $(R_nCp)(R_mFlu)ZrX_2$ or $Y_2$silyl$(R_nCp)(R_mFlu)ZrX_2$ where Y is independently a $C_1$ to $C_{20}$ alkyl or a substituted or unsubstituted phenyl group, X is a halogen, a substituted or unsubstituted phenyl group, or a $C_1$ to $C_{20}$ alkyl, Cp is a cyclopentadienyl ring, R is a $C_1$ to $C_{20}$ alkyl group, n is a number denoting the degree of substitution of Cp and is a number from 0 to 5, Flu is a fluorenyl ring, m is a number denoting the degree of substitution of Flu and is a number from 0 to 9.

Metallocene compounds (pre-catalysts) providing catalyst systems which are specific to the production of poly-α-olefins having mm triads over 40% include the racemic versions of: dimethylsilylbis(indenyl)zirconium dichloride, dimethylsilylbis(indenyl)zirconium dimethyl, diphenylsilylbis(indenyl)zirconium dichloride, diphenylsilylbis(indenyl)zirconium dimethyl, methylphenylsilylbis(indenyl)zirconium dichloride, methylphenylsilylbis(indenyl)zirconium dimethyl, ethylenebis(indenyl)zirconium dichloride, ethylenebis(indenyl)zirconium dimethyl, methylenebis(indenyl)zirconium dichloride, methylenebis(indenyl)zirconium dimethyl, dimethylsilylbis(indenyl)hafnium dichloride, dimethylsilylbis(indenyl)hafnium dimethyl, diphenylsilylbis(indenyl)hafnium dichloride, diphenylsilylbis(indenyl)hafnium dimethyl, methylphenylsilylbis(indenyl)hafnium dichloride, methylphenylsilylbis(indenyl)hafnium dimethyl, ethylenebis(indenyl)hafnium dichloride, ethylenebis(indenyl)hafnium dimethyl, methylenebis(indenyl)hafnium dichloride, methylenebis(indenyl)hafnium dimethyl, dimethylsilylbis(tetrahydroindenyl)zirconium dichloride, dimethylsilylbis(tetrahydroindenyl)zirconium dimethyl, diphenylsilylbis(tetrahydroindenyl)zirconium dichloride, diphenylsilylbis(tetrahydroindenyl)zirconium dimethyl, methylphenylsilylbis(tetrahydroindenyl)zirconium dichloride, methylphenylsilylbis(tetrahydroindenyl)zirconium dimethyl, ethylenebis(tetrahydroindenyl)zirconium dichloride, ethylenebis(tetrahydroindenyl)zirconium dimethyl, methylenebis(tetrahydroindenyl)zirconium dichloride, methylenebis(tetrahydroindenyl)zirconium dimethyl, dimethylsilylbis(tetrahydroindenyl)hafnium dichloride, dimethylsilylbis(tetrahydroindenyl)hafnium dimethyl, diphenylsilylbis(tetrahydroindenyl)hafnium dichloride, diphenylsilylbis(tetrahydroindenyl)hafnium dimethyl, methylphenylsilylbis(tetrahydroindenyl)hafnium dichloride, methylphenylsilylbis(tetrahydroindenyl)hafnium dimethyl, ethylenebis(tetrahydroindenyl)hafnium dichloride, ethylenebis(tetrahydroindenyl)hafnium dimethyl, methylenebis(tetrahydroindenyl)hafnium dichloride, methylenebis(tetrahydroindenyl)hafnium dimethyl, dimethylsilylbis(4,7-dimethylindenyl)zirconium dichloride, dimethylsilylbis(4,7-dimethylindenyl)zirconium dimethyl, diphenylsilylbis(4,7-dimethylindenyl)zirconium dichloride, diphenylsilylbis(4,7-dimethylindenyl)zirconium dimethyl, methylphenylsilylbis(4,7-dimethylindenyl)zirconium dichloride, methylphenylsilylbis(4,7-dimethylindenyl)zirconium dimethyl, ethylenebis(4,7-dimethylindenyl)zirconium dichloride, ethylenebis(4,7-dimethylindenyl)zirconium dimethyl, methylenebis(4,7-dimethylindenyl)zirconium dichloride, methylenebis(4,7-dimethylindenyl)zirconium dimethyl, dimethylsilylbis(4,7-dimethylindenyl)hafnium dichloride, dimethylsilylbis(4,7-dimethylindenyl)hafnium dimethyl, diphenylsilylbis(4,7-dimethylindenyl)hafnium dichloride, diphenylsilylbis(4,7-dimethylindenyl)hafnium dimethyl, methylphenylsilylbis(4,7-dimethylindenyl)hafnium dichloride, methylphenylsilylbis(4,7-dimethylindenyl)hafnium dimethyl, ethylenebis(4,7-dimethylindenyl)hafnium dichloride, ethylenebis(4,7-dimethylindenyl)hafnium dimethyl, methylenebis(4,7-dimethylindenyl)hafnium dichloride, methylenebis(4,7-dimethylindenyl)hafnium dimethyl, dimethylsilylbis(2-methyl-4-napthylindenyl)zirconium dichloride, dimethylsilylbis(2-methyl-4-napthylindenyl)zirconium dimethyl, diphenylsilylbis(2-methyl-4-napthylindenyl)zirconium dichloride, dimethylsilylbis(2,3-dimethylcyclopentadienyl)zirconium dichloride, dimethylsilylbis(2,3-dimethylcyclopentadienyl)zirconium dimethyl, diphenylsilylbis(2,3-dimethylcyclopentadienyl)zirconium dichloride, diphenylsilylbis(2,3-dimethylcyclopentadienyl)zirconium dimethyl, methylphenylsilylbis(2,3-dimethylcyclopentadienyl)zirconium dichloride, methylphenylsilylbis(2,3-dimethylcyclopentadienyl)zirconium dimethyl, ethylenebis(2,3-dimethylcyclopentadienyl)zirconium dichloride, ethylenebis(2,3-dimethylcyclopentadienyl)zirconium dimethyl, methylenebis(2,3-dimethylcyclopentadienyl)zirconium dichloride, methylenebis(2,3-dimethylcyclopentadienyl)zirconium dimethyl, dimethylsilylbis(2,3-dimethylcyclopentadienyl)hafnium dichloride, dimethylsilylbis(2,3 dimethylcyclopentadienyl)hafnium dimethyl, diphenylsilylbis(2,3-dimethylcyclopentadienyl)hafnium dichloride, diphenylsilylbis(2,3-dimethylcyclopentadienyl)hafnium dimethyl, methylphenylsilylbis(2,3-dimethylcyclopentadienyl)hafnium dichloride, methylphenylsilylbis(2,3-dimethylcyclopentadienyl)hafnium dimethyl, ethylenebis(2,3-dimethylcyclopentadienyl)hafnium dichloride, ethylenebis(2,3-dimethylcyclopentadienyl)hafnium dimethyl, methylenebis(2,3-dimethylcyclopentadienyl)hafnium dichloride, methylenebis(2,3-dimethylcyclopentadienyl)hafnium dimethyl, dimethylsilylbis(3-trimethylsilylcyclopentadienyl)zirconium dichloride, dimethylsilylbis(3-trimethylsilylcyclopentadienyl)zirconium dimethyl, diphenylsilylbis(3-trimethylsilylcyclopentadienyl)zirconium dichloride, diphenylsilylbis(3-trimethylsilylcyclopentadienyl)zirconium dimethyl, methylphenylsilylbis(3-trimethylsilylcyclopentadienyl)zirconium dichloride, methylphenylsilylbis(3-trimethylsilylcyclopentadienyl)zirconium dimethyl, ethylenebis(3-trimethylsilylcyclopentadienyl)zirconium dichloride, ethylenebis(3-trimethylsilylcyclopentadienyl)zirconium dimethyl, methylenebis(3-trimethylsilylcyclopentadienyl)zirconium dichloride, methylenebis(3-trimethylsilylcyclopentadienyl)zirconium dimethyl, dimethylsilylbis(3-trimethylsilylcyclopentadienyl)hafnium dichloride, dimethylsilylbis(3-trimethylsilylcyclopentadienyl)hafnium dimethyl, diphenylsilylbis(3-trimethylsilylcyclopentadienyl)hafnium dichloride, diphenylsilylbis(3-trimethylsilylcyclopentadienyl)hafnium dimethyl, methylphenylsilylbis(3-trimethylsilylcyclopentadienyl)hafnium dichloride, methylphenylsilylbis(3-trimethylsilylcyclopentadienyl) hafnium dimethyl, ethylenebis(3-trimethylsilylcyclopentadienyl)hafnium dichloride, ethylenebis(3-trimethylsilylcyclopentadienyl)hafnium dimethyl, methylenebis(3-trimethylsilylcyclopentadienyl)hafnium dichloride, methylenebis(3-trimethylsilylcyclopentadienyl)hafnium dimethyl.

In one form, the species are the racemic versions of: dimethylsilylbis(indenyl)zirconium dichloride, dimethylsilylbis(indenyl)zirconium dimethyl, ethylenebis(indenyl)zirconium dichloride, ethylenebis(indenyl)zirconium dimethyl, dimethylsilylbis(tetrahydroindenyl)zirconium dichloride, dimethylsilylbis(tetrahydroindenyl)zirconium dimethyl, ethylenebis(tetrahydroindenyl)zirconium dichloride, ethylenebis(tetrahydroindenyl)zirconium dimethyl, dimethylsilylbis(4,7-dimethylindenyl)zirconium dichloride, dimethylsilylbis(4,7-dimethylindenyl)zirconium dimethyl, ethylenebis(4,7-dimethylindenyl)zirconium dichloride, ethylenebis(4,7-dimethylindenyl)zirconium dimethyl, dimethylsilylbis(indenyl)hafnium dichloride, dimethylsilylbis(indenyl)hafnium dimethyl, ethylenebis(indenyl)hafnium dichloride, ethylenebis(indenyl)hafnium dimethyl, dimethylsilylbis(tetrahydroindenyl)hafnium dichloride, dimethylsilylbis(tetrahydroindenyl)hafnium dimethyl, ethylenebis(tetrahydroindenyl)hafnium dichloride, ethylenebis (tetrahydroindenyl)hafnium dimethyl, dimethylsilylbis(4,7-dimethylindenyl)hafnium dichloride, dimethylsilylbis(4,7-dimethylindenyl)hafnium dimethyl, ethylenebis(4,7-dimethylindenyl)hafnium dichloride, and ethylenebis(4,7-dimethylindenyl)hafnium dimethyl. In another form, the catalyst compounds also include bis(1,3-dimethylcyclopentadienyl)zirconium dichloride and bis(tetramethylcyclopentadienyl)zirconium dichloride.

The catalyst precursors, when activated by a commonly known activator such as methylalumoxane, form active catalysts for the polymerization or oligomerization of olefins. Activators that may be used include alumoxanes such as methylalumoxane, modified methylalumoxane, ethylalumoxane, iso-butylalumoxane and the like; Lewis acid activators include triphenylboron, tris-perfluorophenylboron, tris-perfluorophenylaluminum and the like; ionic activators include dimethylanilinium tetrakisperfluorophenylborate, triphenylcarboniumtetrakis perfluorophenylborate, dimethylaniliniumtetrakisperfluorophenylaluminate, and the like.

A co-activator is a compound capable of alkylating the transition metal complex, such that when used in combination with an activator, an active catalyst is formed. Co-activators include alumoxanes such as methylalumoxane, modified alumoxanes such as modified methylalumoxane, and aluminum alkyls such trimethylaluminum, tri-isobutylaluminum, triethylaluminum, and tri-isopropylaluminum, tri-n-hexylaluminum, tri-n-octylaluminum, tri-n-decylaluminum or tri-n-dodecylaluminum. Co-activators are typically used in combination with Lewis acid activators and ionic activators when the pre-catalyst is not a dihydrocarbyl or dihydride complex. Sometimes co-activators are also used as scavengers to deactivate impurities in feed or reactors.

Useful co-activators include alkylaluminum compounds represented by the formula: $R_3Al$, where each R is, independently, a $C_1$ to $C_{18}$ alkyl group, or each R is independently selected from the group consisting of methyl, ethyle, n-propyl, iso-propyl, iso-butyl, n-butyl, t-butyl, n-pentyl, iso-pentyl, neopentyl, n-hexyl, iso-hexyl, n-heptyl, iso-heptyl, n-octyl, iso-octyl, n-nonyl, n-decyl, n-undecyl, n-dodecyl, n-ridecyl, n-tetradecyl, n-pentadecy, n-hexadecyl, n-heptadecyl, n-octadecyl, and their iso-analogs.

The alumoxane component useful as an activator typically may be an oligomeric aluminum compound represented by the general formula $(R^x—Al—O)_n$, which is a cyclic compound, or $R^x(R^x—Al—O)_nAlR^x_2$, which is a linear compound. It is believed that the most common alumoxanes are a mixture of the cyclic and linear compounds. In the general alumoxane formula, Rx is independently a $C_1$-$C_{20}$ alkyl radical, for example, methyl, ethyl, propyl, butyl, pentyl, isomers thereof, and the like, and "n" is an integer from 1-50. In one form, Rx is methyl and "n" is at least 4. In another form, methylalumoxane and modified methylalumoxanes may be used. For further descriptions see, EP 0 279 586, EP 0 594 218, EP 0 561 476, WO 94/10180 and U.S. Pat. Nos. 4,665,208, 4,874,734, 4,908,463, 4,924,018, 4,952,540, 4,968,827, 5,041,584, 5,091,352, 5,103,031, 5,157,137, 5,204,419, 5,206,199, 5,235,081, 5,248,801, 5,329,032, 5,391,793, and 5,416,229.

When an alumoxane or modified alumoxane is used, the catalyst-precursor-to-activator molar ratio is from 1:3000 to 10:1; alternatively, 1:2000 to 10:1; alternatively 1:1000 to 10:1; alternatively, 1:500 to 1:1; alternatively 1:300 to 1:1; alternatively 1:250 to 1:1, alternatively 1:200 to 1:1; alternatively 1:100 to 1:1; alternatively 1:50 to 1:1; alternatively 1:10 to 1:1. When the activator is an alumoxane (modified or unmodified), some forms select the maximum amount of activator at a 5000 fold molar excess over the catalyst precursor (per metal catalytic site). In one form, the minimum activator to catalyst precursor ratio is 1:1 molar ratio.

Ionic activators (at times used in combination with a co-activator) may be used herein. Discrete ionic activators such as $[Me_2PhNH][B(C_6F_5)_4]$, $[Ph_3C][B(C_6F_5)_4]$, $[Me_2PhNH][B((C_6H_3\text{-}3,5\text{-}(CF_3)_2))_4]$, $[Ph_3C][B((C_6H_3\text{-}3,5\text{-}(CF_3)_2))_4]$, $[NH_4][B(C_6H_5)_4]$ or Lewis acidic activators such as $B(C_6F_5)_3$ or $B(C_6H_5)_3$ can be used, where Ph is phenyl and Me is methyl. Co-activators, when used, may include alumoxanes such as methylalumoxane, modified alumoxanes such as modified methylalumoxane, and aluminum alkyls such as tri-isobutylaluminum, and trimethylaluminum, triethylaluminum, and tri-isopropylaluminum, tri-n-hexylaluminum, tri-n-octylaluminum, tri-n-decylaluminum or tri-n-dodecylaluminum.

It is within the scope of this disclosure to use an ionizing or stoichiometric activator, neutral or ionic, such as tri(n-butyl) ammoniumtetrakis(pentafluorophenyl)borate, a trisperfluorophenyl boron metalloid precursor or a trisperfluoronaphthyl boron metalloid precursor, polyhalogenated heteroborane anions (WO 98/43983), boric acid (U.S. Pat. No. 5,942,459) or combination thereof.

Examples of neutral stoichiometric activators include tri-substituted boron, tellurium, aluminum, gallium and indium or mixtures thereof. The three substituent groups are each independently selected from alkyls, alkenyls, halogen, substituted alkyls, aryls, arylhalides, alkoxy and halides. In one form, the three groups are independently selected from halogen, mono or multicyclic (including halosubstituted) aryls, alkyls, and alkenyl compounds and mixtures thereof, and may be alkenyl groups having 1 to 20 carbon atoms, alkyl groups having 1 to 20 carbon atoms, alkoxy groups having 1 to 20 carbon atoms and aryl groups having 3 to 20 carbon atoms (including substituted aryls). In another form, the three groups may be alkyls having 1 to 4 carbon groups, phenyl, naphthyl or mixtures thereof. In yet another form, the three groups are halogenated, such as fluorinated aryl groups. In still yet another form, the neutral stoichiometric activator is trisperfluorophenyl boron or trisperfluoronaphthyl boron.

Ionic stoichiometric activator compounds may contain an active proton, or some other cation associated with, but not coordinated to, or only loosely coordinated to, the remaining ion of the ionizing compound. Such compounds and the like are described in European publications EP-A-0 570 982, EP-A-0 520 732, EP-A-0 495 375, EP-B1-0 500 944, EP-A-0 277 003 and EP-A-0 277 004, and U.S. Pat. Nos. 5,153,157, 5,198,401, 5,066,741, 5,206,197, 5,241,025, 5,384,299 and 5,502,124 and U.S. patent application Ser. No. 08/285,380, filed Aug. 3, 1994, all of which are herein fully incorporated by reference.

Ionic catalysts can be prepared by reacting a transition metal compound with an activator, such as $B(C_6F_6)_3$, which upon reaction with the hydrolyzable ligand (X') of the transition metal compound forms an anion, such as ($[B(C_6F_5)_3(X')]^-$), which stabilizes the cationic transition metal species generated by the reaction. The catalysts can be prepared with activator components which are ionic compounds or compositions. However preparation of activators utilizing neutral compounds is also contemplated by this disclosure.

Compounds useful as an activator component in the preparation of the ionic catalyst systems used herein comprise a cation, which may be a Bronsted acid capable of donating a proton, and a compatible non-coordinating anion which anion is relatively large (bulky), capable of stabilizing the active catalyst species which is formed when the two compounds are combined and said anion will be sufficiently labile to be displaced by olefinic diolefinic and acetylenically unsaturated substrates or other neutral Lewis bases such as ethers, nitriles and the like. Two classes of compatible non-coordinating anions have been disclosed in EPA 277,003 and EPA 277,004 published 1988: 1) anionic coordination complexes comprising a plurality of lipophilic radicals covalently coordinated to and shielding a central charge-bearing metal or metalloid core, and 2) anions comprising a plurality of boron atoms such as carboranes, metallacarboranes and boranes.

In one form, the stoichiometric activators include a cation and an anion component, and may be represented by the following formula:

$$(L^{**}\text{-}H)_d^+(A^{d-})$$

wherein:

L** is an neutral Lewis base;

H is hydrogen;

(L**-H)+ is a Bronsted acid;

$A^{d-}$ is a non-coordinating anion having the charge d−; and d is an integer from 1 to 3.

The cation component, $(L^{**}\text{-}H)_d^+$ may include Bronsted acids such as protons or protonated Lewis bases or reducible Lewis acids capable of protonating or abstracting a moiety, such as an alkyl or aryl, from the precatalyst after alkylation.

The activating cation $(L^{}\text{-}H)_d^+$ may be a Bronsted acid, capable of donating a proton to the alkylated transition metal catalytic precursor resulting in a transition metal cation, including ammoniums, oxoniums, phosphoniums, silyliums, and mixtures thereof, ammoniums of methylamine, aniline, dimethylamine, diethylamine, N-methylaniline, diphenylamine, trimethylamine, triethylamine, N,N-dimethylaniline, methyldiphenylamine, pyridine, p-bromo N,N-dimethylaniline, p-nitro-N,N-dimethylaniline, phosphoniums from triethylphosphine, triphenylphosphine, and diphenylphosphine, oxomiuns from ethers such as dimethyl ether, diethyl ether, tetrahydrofuran and dioxane, sulfoniums from thioethers, such as diethyl thioethers and tetrahydrothiophene, and mixtures thereof. The activating cation $(L^{}\text{-}H)_d^+$ may also be a moiety such as silver, tropylium, carbeniums, ferroceniums and mixtures, carboniums and ferroceniums; and triphenyl carbonium.

The anion component $A^{d-}$ include those having the formula $[M^{k+}Q_n]^{d-}$ wherein k is an integer from 1 to 3; n is an integer from 2-6; n−k=d; M is an element selected from Group 13 of the Periodic Table of the Elements, such as boron or aluminum, and Q is independently a hydride, bridged or unbridged dialkylamido, halide, alkoxide, aryloxide, hydrocarbyl, substituted hydrocarbyl, halocarbyl, substituted halocarbyl, and halosubstituted-hydrocarbyl radicals, said Q having up to 20 carbon atoms with the proviso that in not more than one occurrence is Q a halide. In one form, each Q is a fluorinated hydrocarbyl group having 1 to 20 carbon atoms. In another form, each Q is a fluorinated aryl group, such as a pentafluoryl aryl group. Examples of suitable $A^{d-}$ also include diboron compounds as disclosed in U.S. Pat. No. 5,447,895, which is fully incorporated herein by reference.

Illustrative, but not limiting examples of boron compounds which may be used as an activating cocatalyst in combination with a co-activator in the preparation of the catalysts disclosed herein are tri-substituted ammonium salts such as: trimethylammonium tetraphenylborate, triethylammonium tetraphenylborate, tripropylammonium tetraphenylborate, tri(n-butyl)ammonium tetraphenylborate, tri(tert-butyl)ammonium tetraphenylborate, N,N-dimethylanilinium tetraphenylborate, N,N-diethylanilinium tetraphenylborate, N,N-dimethyl-(2,4,6-trimethylanilinium)tetraphenylborate, trimethylammonium tetrakis(pentafluorophenyl)borate, triethylammonium tetrakis(pentafluorophenyl)borate, tripropylammonium tetrakis(pentafluorophenyl)borate, tri(n-butyl)ammonium tetrakis(pentafluorophenyl)borate, tri(sec-butyl)ammonium tetrakis(pentafluorophenyl)borate, N,N-dimethylanilinium tetrakis(pentafluorophenyl)borate, N,N-diethylanilinium tetrakis(pentafluorophenyl)borate, N,N-dimethyl-(2,4,6-trimethylanilinium)tetrakis (pentafluorophenyl)borate, trimethylammonium tetrakis-(2,3,4,6-tetrafluorophenyl)borate, triethylammonium tetrakis-(2,3,4,6-tetrafluorophenyl)borate, tripropylammonium tetrakis-(2,3,4,6-tetrafluorophenyl)borate, tri(n-butyl)ammonium tetrakis-(2,3,4,6-tetrafluorophenyl)borate, dimethyl (tert-butyl)ammonium tetrakis-(2,3,4,6-tetrafluorophenyl) borate, N,N-dimethylanilinium tetrakis-(2,3,4,6-tetrafluorophenyl)borate, N,N-diethylanilinium tetrakis-(2,3,4,6-tetrafluorophenyl)borate, N,N-dimethyl-(2,4,6-trimethylanilinium)tetrakis-(2,3,4,6-tetrafluorophenyl) borate, trimethylammonium tetrakis(perfluoronaphthyl) borate, triethylammonium tetrakis(perfluoronaphthyl) borate, tripropylammonium tetrakis(perfluoronaphthyl) borate, tri(n-butyl)ammonium tetrakis(perfluoronaphthyl) borate, tri(tert-butyl)ammonium tetrakis(perfluoronaphthyl) borate, N,N-dimethylanilinium tetrakis(perfluoronaphthyl) borate, N,N-diethylanilinium tetrakis(perfluoronaphthyl) borate, N,N-dimethyl-(2,4,6-trimethylanilinium)tetrakis (perfluoronaphthyl)borate, trimethylammonium tetrakis (perfluorobiphenyl)borate, triethylammonium tetrakis (perfluorobiphenyl)borate, tripropylammonium tetrakis (perfluorobiphenyl)borate, tri(n-butyl)ammonium tetrakis (perfluorobiphenyl)borate, tri(tert-butyl)ammonium tetrakis (perfluorobiphenyl)borate, N,N-dimethylanilinium tetrakis (perfluorobiphenyl)borate, N,N-diethylanilinium tetrakis (perfluorobiphenyl)borate, N,N-dimethyl-(2,4,6-trimethylanilinium)tetrakis(perfluorobiphenyl)borate, trimethylammonium tetrakis(3,5-bis(trifluoromethyl)phenyl)borate, triethylammonium tetrakis(3,5bis(trifluoromethyl)phenyl)borate, tripropylammonium tetrakis(3,5-bis(trifluoromethyl)phenyl)borate, tri(n-butyl)ammonium tetrakis(3,5-bis(trifluoromethyl)phenyl)borate, tri(tert-butyl)ammonium tetrakis(3,5-bis(trifluoromethyl)phenyl)borate, N,N-dimethylanilinium tetrakis(3,5-bis(trifluoromethyl)phenyl)borate, N,N-diethylanilinium tetrakis(3,5-bis(trifluoromethyl)phenyl)borate, N,N-dimethyl-(2,4,6-trimethylanilinium)tetrakis(3,5-bis(trifluoromethyl)phenyl)borate, and dialkyl ammonium salts such as: di-(iso-propyl)ammonium tetrakis(pentafluorophenyl)borate, and dicyclohexylammonium tetrakis(pentafluorophenyl)borate; and other salts such as tri(o-tolyl)phosphonium tetrakis(pentafluorophenyl)borate, tri(2,6-dimethylphenyl)phosphonium tetrakis(pentafluorophenyl)borate, tropillium tetraphenylborate, triphenylcarbenium tetraphenylborate, triphenylphosphonium tetraphenylborate, triethylsilylium tetraphenylborate, benzene(diazonium)tetraphenylborate, tropillium tetrakis(pentafluorophenyl)borate, triphenylcarbenium tetrakis(pentafluorophenyl)borate, triphenylphosphonium tetrakis (pentafluorophenyl)borate, triethylsilylium tetrakis (pentafluorophenyl)borate, benzene(diazonium)tetrakis (pentafluorophenyl)borate, tropillium tetrakis-(2,3,4,6-tetrafluorophenyl)borate, triphenylcarbenium tetrakis-(2,3,4,6-tetrafluorophenyl)borate, triphenylphosphonium tetrakis-(2,3,4,6-tetrafluorophenyl)borate, triethylsilylium tetrakis-(2,3,4,6-tetrafluorophenyl)borate, benzene(diazonium) tetrakis-(2,3,4,6-tetrafluorophenyl)borate, tropillium tetrakis (perfluoronaphthyl)borate, triphenylcarbenium tetrakis (perfluoronaphthyl)borate, triphenylphosphonium tetrakis (perfluoronaphthyl)borate, triethylsilylium tetrakis (perfluoronaphthyl)borate, benzene(diazonium)tetrakis (perfluoronaphthyl)borate, tropillium tetrakis (perfluorobiphenyl)borate, triphenylcarbenium tetrakis (perfluorobiphenyl)borate, triphenylphosphonium tetrakis (perfluorobiphenyl)borate, triethylsilylium tetrakis (perfluorobiphenyl)borate, benzene(diazonium)tetrakis (perfluorobiphenyl)borate, tropillium tetrakis(3,5-bis (trifluoromethyl)phenyl)borate, triphenylcarbenium tetrakis (3,5-bis(trifluoromethyl)phenyl)borate, triphenylphosphonium tetrakis(3,5-bis(trifluoromethyl)phenyl)borate, triethylsilylium tetrakis(3,5-bis(trifluoromethyl) phenyl)borate, and benzene(diazonium)tetrakis(3,5-bis(trifluoromethyl)phenyl)borate.

In one form, the ionic stoichiometric activator $(L^{**}\text{-}H)_d^+$ $(A^{d-})$ is N,N-dimethylanilinium tetrakis(perfluorophenyl) borate, N,N-dimethylanilinium tetrakis(perfluoronaphthyl) borate, N,N-dimethylanilinium tetrakis(perfluorobiphenyl) borate, N,N-dimethylanilinium tetrakis(3,5-bis (trifluoromethyl)phenyl)borate, triphenylcarbenium tetrakis (perfluoronaphthyl)borate, triphenylcarbenium tetrakis (perfluorobiphenyl)borate, triphenylcarbenium tetrakis(3,5-bis(trifluoromethyl)phenyl)borate, or triphenylcarbenium tetra(perfluorophenyl)borate.

The catalyst precursors can also be activated with cocatalysts or activators that comprise non-coordinating anions containing metalloid-free cyclopentadienide ions. These are described in U.S. Patent Publication 2002/0058765 A1, published on 16 May 2002, and require the addition of a co-activator to the catalyst pre-cursor. "Compatible" non-coordinating anions are those which are not degraded to neutrality when the initially formed complex decomposes. Further, the anion will not transfer an anionic substituent or fragment to the cation so as to cause it to form a neutral transition metal compound and a neutral by-product from the anion. Non-coordinating anions useful herein are those that are compatible, stabilize the transition metal complex cation in the sense of balancing its ionic charge at +1, and yet retain sufficient lability to permit displacement by an ethylenically or acetylenically unsaturated monomer during polymerization. These types of cocatalysts are sometimes used with scavengers such as but not limited to tri-iso-butylaluminum, tri-n-octylaluminum, tri-n-hexylaluminum, triethylaluminum or trimethylaluminum.

The processes disclosed herein can employ cocatalyst compounds or activator compounds that are initially neutral Lewis acids but form a cationic metal complex and a noncoordinating anion, or a zwitterionic complex upon reaction with the alkylated transition metal compounds. The alkylated metallocene compound is formed from the reaction of the catalyst pre-cursor the co-activator. For example, tris(pentafluorophenyl)boron or aluminum act to abstract a hydrocarbyl ligand to yield a cationic transition metal complex and stabilizing noncoordinating anion, see EP-A-0 427 697 and EP-A-0 520 732 for illustrations of analogous Group-4 metallocene compounds. Also, see the methods and compounds of EP-A-0 495 375. For formation of zwitterionic complexes using analogous Group 4 compounds, see U.S. Pat. Nos. 5,624,878; 5,486,632; and 5,527,929.

Additional neutral Lewis-acids are known in the art and are suitable for abstracting formal anionic ligands. See in particular the review article by E. Y.-X. Chen and T. J. Marks, "Cocatalysts for Metal-Catalyzed Olefin Polymerization: Activators, Activation Processes, and Structure-Activity Relationships", Chem. Rev., 100, 1391-1434 (2000).

When the cations of noncoordinating anion precursors are Bronsted acids such as protons or protonated Lewis bases (excluding water), or reducible Lewis acids such as ferrocenium or silver cations, or alkali or alkaline earth metal cations such as those of sodium, magnesium or lithium, the catalyst precursor-to-activator molar ratio may be any ratio. Combinations of the described activator compounds may also be used for activation.

When an ionic or neutral stoichiometric activator (such as an NCA) is used, the catalyst-precursor-to-activator molar ratio is from 1:10 to 1:1; 1:10 to 10:1; 1:10 to 2:1; 1:10 to 3:1; 1:10 to 5:1; 1:2 to 1.2:1; 1:2 to 10:1; 1:2 to 2:1; 1:2 to 3:1; 1:2 to 5:1; 1:3 to 1.2:1; 1:3 to 10:1; 1:3 to 2:1; 1:3 to 3:1; 1:3 to 5:1; 1:5 to 1:1; 1:5 to 10:1; 1:5 to 2:1; 1:5 to 3:1; 1:5 to 5:1; 1:1 to 1:1.2. The catalyst-precursor-to-co-activator molar ratio is from 1:500 to 1:1, 1:100 to 100:1; 1:75 to 75:1; 1:50 to 50:1; 1:25 to 25:1; 1:15 to 15:1; 1:10 to 10:1; 1:5 to 5:1, 1:2 to 2:1; 1:100 to 1:1; 1:75 to 1:1; 1:50 to 1:1; 1:25 to 1:1; 1:15 to 1:1; 1:10 to 1:1; 1:5 to 1:1; 1:2 to 1:1; 1:10 to 2:1.

Useful activators and activator/co-activator combinations include methylalumoxane, modified methylalumoxane, mixtures of methylalumoxane with dimethylanilinium tetrakis (pentafluorophenyl)borate or tris(pentafluorophenyl)boron, and mixtures of trimethyl aluminum with dimethylanilinium tetrakis(pentafluorophenyl)borate or tris(pentafluorophenyl) boron.

In some forms, scavenging compounds are used with stoichiometric activators. Typical aluminum or boron alkyl components useful as scavengers are represented by the general formula $R^xJZ_2$ where J is aluminum or boron, Rx is as previously defined above, and each Z is independently Rx or a different univalent anionic ligand such as halogen (Cl, Br, I), alkoxide ($OR^x$) and the like. In another form, aluminum alkyls include triethylaluminum, diethylaluminum chloride, tri-iso-butylaluminum, tri-n-octylaluminum, tri-n-hexylaluminum, trimethylaluminum and the like are employed. In yet another form, the boron alkyls include triethylboron. Scavenging compounds may also be alumoxanes and modified alumoxanes including methylalumoxane and modified methylalumoxane.

Supported catalysts and or supported catalyst systems may be used to prepare PAO's. To prepare uniform supported catalysts, the catalyst precursor dissolves in the chosen solvent. The term "uniform supported catalyst" means that the catalyst precursor, the activator, and or the activated catalyst approach uniform distribution upon the support's accessible surface area, including the interior pore surfaces of porous supports. Some forms of supported catalysts prefer uniform supported catalysts; other forms show no such preference.

Useful supported catalyst systems may be prepared by any method effective to support other coordination catalyst systems, effective meaning that the catalyst so prepared can be used for oligomerizing or polymerizing olefins in a heterogenous process. The catalyst precursor, activator, co-activator (if needed), suitable solvent, and support may be added in any order or simultaneously.

By one method, the activator, dissolved in an appropriate solvent such as toluene, may be stirred with the support material for 1 minute to 10 hours to prepare the supported catalyst. The total solution volume (of the catalyst solution, the activator solution or both) may be greater than the pore volume of the support, but some forms limit the total solution volume below that needed to form a gel or slurry (90% to 400%, or 100-200%, of the pore volume). The mixture is optionally heated from 30-200° C. during this time. The catalyst precursor may be added to this mixture as a solid, if a suitable solvent is employed in the previous step, or as a solution. Alternatively, the mixture can be filtered, and the resulting solid mixed with a catalyst precursor solution. Similarly, the mixture may be vacuum-dried and mixed with a catalyst precursor solution. The resulting catalyst mixture is then stirred for 1 minute to 10 hours, and the supported catalyst is either filtered from the solution and vacuum dried or subjected to evaporation to remove the solvent.

Alternatively, the catalyst precursor and activator may be combined in solvent to form a solution. The support is then added to the solution, and the resulting mixture is stirred for 1 minute to 10 hours. The total activator/catalyst-precursor solution volume may be greater than the pore volume of the support, but some forms limit the total solution volume below that needed to form a gel or slurry (90% to 400%, or 100-200% of the pore volume). After stirring, the residual solvent is removed under vacuum, typically at ambient temperature and over 10-16 hours; however, greater or lesser times and temperatures may be used.

The catalyst precursor may also be supported absent the activator; in this case, the activator (and co-activator if needed) is added to a the liquid phase of a slurry process. For example, a solution of catalyst precursor may be mixed with a support material for a period of 1 minute to 10 hours. The resulting precatalyst mixture may be filtered from the solution and dried under vacuum or treated with evaporation to remove the solvent. The total catalyst-precursor-solution volume may be greater than the support's pore volume, but some forms limit the total solution volume below that needed to form a gel or slurry (90% to 400%, or 100-200% of the pore volume).

Additionally, two or more different catalyst precursors may be placed on the same support using any of the support methods disclosed above. Likewise, two or more activators or an activator and a co-activator, may be placed on the same support.

Suitable solid particle supports are typically comprised of polymeric or refractory oxide materials, each of which may be porous. Any support material that has an average particle size greater than 10 μm is suitable for use herein. Various forms select a porous support material, such as for example, talc, inorganic oxides, inorganic chlorides, for example magnesium chloride and resinous support materials such as polystyrene polyolefin or polymeric compounds or any other organic support material and the like. Some forms select inorganic oxide materials as the support material including Group-2, -3, -4, -5, -13, or -14 metal or metalloid oxides. Some forms select the catalyst support materials to include silica, alumina, silica-alumina, and their mixtures. Other inorganic oxides may serve either alone or in combination with the silica, alumina, or silica-alumina. These are magnesia, titania, zirconia, and the like. Lewis acidic materials such as montmorillonite and similar clays may also serve as a support. In this case, the support can optionally double as an activator component. But additional activator may also be used. In some cases, a special family of solid support commonly known as MCM-41 can also be used. MCM-41 is a new class of unique crystalline support and can be prepared with tunable pore size and tunable acidity when modified with a second component. A detailed description of this class of materials and their modification can be found in U.S. Pat. No. 5,264,203.

The support material may be pretreated by any number of methods. For example, inorganic oxides may be calcined, chemically treated with dehydroxylating agents such as aluminum alkyls and the like, or both.

As stated above, polymeric carriers will also be suitable, see for example the descriptions in WO 95/15815 and U.S. Pat. No. 5,427,991. The methods disclosed may be used with the catalyst compounds, activators or catalyst systems disclosed herein to adsorb or absorb them on the polymeric supports, particularly if made up of porous particles, or may be chemically bound through functional groups bound to or in the polymer chains.

Useful catalyst carriers may have a surface area of from 10-700 $m^2/g$, and or a pore volume of 0.1-4.0 cc/g and or an average particle size of 10-500 μm. Some forms select a surface area of 50-500 $m^2/g$, and or a pore volume of 0.5-3.5 cc/g, and or an average particle size of 20-200 μm. Other forms select a surface area of 100400 $m^2/g$, and or a pore volume of 0.8-3.0 cc/g, and or an average particle size of 30-100 μm. The carriers typically have a pore size of 10-1000 Angstroms, alternatively 50-500 Angstroms, or 75-350 Angstroms.

The metallocenes and or the metallocene/activator combinations are generally deposited on the support at a loading level of 10-100 micromoles of catalyst precursor per gram of solid support; alternately 20-80 micromoles of catalyst precursor per gram of solid support; or 40-60 micromoles of catalyst precursor per gram of support. But greater or lesser values may be used provided that the total amount of solid catalyst precursor does not exceed the support's pore volume.

The metallocenes and or the metallocene/activator combinations can be supported for gas-phase, bulk, or slurry polymerization, or otherwise as needed. Numerous support methods are known for catalysts in the olefin polymerization art, particularly alumoxane-activated catalysts; all are suitable for use herein. See, for example, U.S. Pat. Nos. 5,057,475 and 5,227,440. An example of supported ionic catalysts appears in WO 94/03056. U.S. Pat. No. 5,643,847 and WO 96/04319A which describe a particularly effective method. Both polymers and inorganic oxides may serve as supports, see U.S. Pat. Nos. 5,422,325, 5,427,991, 5,498,582 and 5,466,649, and international publications WO 93/11172 and WO 94/07928.

In one form, the metallocene and or activator (with or without a support) are combined with an alkylaluminum compound, such as a trialkylaluminum compound, prior to entering the reactor. The alkylaluminum compound may be represented by the formula: $R_3Al$, where each R is independently a $C_1$ to $C_{20}$ alkyl group; the R groups may be independently selected from the group consisting of methyl, ethyl, propyl, isopropyl, butyl, isobutyl, n-butyl, pentyl, isopentyl, n-pentyl, hexyl, isohexyl, n-hexyl, heptyl, octyl, isooctyl, n-octyl, nonyl, isononyl, n-nonyl, decyl, isodecyl, n-decyl, undecyl, isoundecyl, n-undecyl, dodecyl, isododecyl, and n-dodecyl, isobutyl, n-octyl, n-hexyl, and n-dodecyl. In another form, the alkylaluminum compound is selected from tri-isobutyl aluminum, tri n-octyl aluminum, tri-n-hexyl aluminum, and tri-n-dodecyl aluminum.

The product from the polymerization reaction can be isolated from the reaction mixture by filtration when the solid supported catalyst is used. Alternatively, when a homogeneous catalyst is used, the product can be isolated by first deactivating the catalyst by exposure to air, $CO_2$, or any catalyst poison, followed by washing the organic layer with dilute acid or base to remove the metal component, the activator and the co-activator. The organic layer containing the polymerization product can be recovered. Alternatively, the homogenous catalyst components in the reaction product can be absorbed by a solid sorbant, such as natural or synthetic clay, Celite, silica, alumina, or any solid supports with high surface area and large pore volume. After long enough contact of a few minutes to 5 hours, the product can be isolated by filtration to remove solids. Alternatively, the solid sorbant material can be packed inside a fix-bed column and the catalyst can be absorbed by continuous passing the liquid through the solid reactor. The lube fraction can be isolated by distillation or fractionation at high temperature together with some vacuum.

The product recovered from an oligomerization using a metallocene catalyst of the type described herein may have a kinematic viscosity measured at 100° C. of between 3.5 cS and 5000 cS, with a viscosity index above 100 to 400 and a pour point below 0° C. to less than −60° C. The VI of the finished lube products disclosed herein can be much higher than the VI provided by any other method. As may be appreciated, this is a unique advantage of using the Fischer-Tropsch wax derived olefins disclosed herein as feed.

Products

As indicated, the product oligomers have a very wide range of viscosities greater than 1 cS at 100° C. with high viscosity indices suitable for high performance lubrication use. Viscosity indices greater than 100 are produced with pour points below −15° C. The product oligomers may be fractionated to obtain material with an average carbon number of greater than 24, or greater than 26, or greater than 28, or greater than 30.

According to the practice typical in the petroleum lubricant arts the products from Lewis acid, metal oxide or metallocene catalyzed oligomerization may optionally be hydrogenated to saturate residual olefinic bonds and yield a bromine number of less than 2. As may be appreciated, the lower the bromine number, the better the oxidative stability. Advantageously, low bromine numbers, less than 0.5 or even less than 0.1, may be achieved from high quality oligomeric products.

Hydrogenation can be carried out by any of numerous methods well known to those skilled in the art. One method is to hydrogenate the product at elevated temperature and pressure in contact with Pd or Pt on charcoal. It has been found that when the hydrogenated product is tested for thermal stability by heating at 280° C. under nitrogen for 24 hours and the results compared to those achieved by synthetic lube produced by oligomerization of mixtures of alpha olefins from an ethylene growth reaction or by oligomerization of 1-decene, the product shows a thermal stability comparable to the commercial synthetic hydrocarbon lubricants.

In certain cases, the oligomerized product is not hydrofinished. The unsaturated double bonds in these oligomers offer reactive centers for further functionalization to convert the fluids into functionalized fluids with unique performance features. For example, the unsaturated oligomers can react with maleic anhydride to give maleated hydrocarbons, which can be further converted into dispersants for use in fuels, lubricants and many other product formulations. The oligomers with unsaturated double bonds can also react with phenols, naphthols, etc to give high molecular weight anti-oxidants with superior viscometrics and thermal oxidative stability. Additionally, the oligomers with unsaturated double bonds can react with peroxydation reagents to convert into epoxides or diols, which can be used as additives or raw material The heavy lube product after hydrofinishing can be blended with hydroisomerized Fisher-Tropsch wax other low, less than 8 cS, materials (e.g. hydroisomerized waxy petroleum-based lubes), to obtain a wide range of lubes of different viscosity range and improved properties. This provides an all-gas route to a range of lubes. This oligomerization product can also be used as raw material for further functionalization, which can significantly improve the total product value from the Fisher-Tropsch plant.

The synthesized lube products disclosed herein can also be blended with other base stocks to produce fluids with increased viscosity, improved VI, pour points, low temperature viscosities by CCS or MRV methods. Examples of these other base stocks include Group I, II, III, III+, Group IV or PAO base stocks, Group V including esters, alkylated naphthalenes, alkylbenzenes, polyalkylene glycols and Group VI base stocks (polyinternal olefins).

Now, specific forms will be described in further detail with reference to the following non-limiting examples.

EXAMPLES

A Fisher-Tropsch wax was cracked over several runs conducted at 570-610° C. to yield product mixtures containing up to 50% $C_5$ to $C_{18}$. The majority of the carbon numbers had over 90% linear alpha-olefins.

The mixtures were first fractionated up to 200° C. at atmospheric pressure to separate light olefins, followed by vacuum distillation at 10-50 torr up to 220° C. to separate most of the higher alpha-olefins, up to $C_{18}$. The two olefin fractions were combined and used for the reactions detailed below.

Example 1

A series of cracking runs were conducted to determine the conditions that yielded 25 to 30% conversion, a good conversion level to maintain high selectivity to $C_6$-$C_{18}$ product. The reactor was a 0.5 inch O.D. stainless steel tube in a furnace, packed with coarse quartz chips. The total internal reactor volume in the heated zone was 42 $cm^3$. The free volume after adding quartz chips was 18 $cm^3$. This free volume was used in calculating liquid hourly space velocity As shown in Table B, significantly milder conditions were required to crack Fisher-Tropsch wax than required for cracking petroleum waxes. As may be seen below, 555° C. was found to be the optimal temperature for run C. When cracking petroleum waxes, temperatures of 590° C. are typically required at similar flow rates and reactor volumes to achieve the same conversion.

Without wishing to be bound by any theory, it is thought that Fisher-Tropsch waxes may be easier to crack due to their relatively high oxygenate and olefin content, compared to petroleum waxes.

TABLE B

Fisher-Tropsch Wax Cracking Runs

| | Run | | | |
|---|---|---|---|---|
| | A | B | C | D |
| Feed | | | | |
| Wax (ml/hr) | 50 | 30 | 50 | 50 |
| $N_2$ (cc/min) | 30 | 18 | 30 | 30 |
| Temp. ° C. | 590 | 570 | 540 | 555 |
| Yields | | | | |
| $C_5$− yld, wt % | 21.73 | 19.62 | 6.01 | 9.26 |
| $C_6$-$C_{18}$ yld, wt % | 31.08 | 27.24 | 12.22 | 18.28 |
| $C_{19}$+ yld, wt % | 47.61 | 53.55 | 81.90 | 72.65 |
| Conversions, wt % | | | | |
| $C_{19+}$ | 52.27 | 46.32 | 17.90 | 27.14 |
| Selectivity (on $C_{19+}$ conv), wt % | | | | |
| $C_1$-$C_2$ | 18.62 | 21.05 | 15.24 | 15.28 |
| $C_3$-$C_5$ | 22.95 | 21.30 | 18.32 | 18.82 |
| $C_6$-$C_{18}$ | 59.45 | 58.61 | 68.26 | 67.36 |

Example 2

A first alpha-olefin mixture of $C_5$ to $C_{18}$ prepared by wax cracking, atmospheric distillation and vacuum distillation was used in this example. Eight grams of this alpha-olefin mixture and 0.4 grams of solid $AlCl_3$ catalyst were mixed at room temperature and stirred overnight. The solution became dark red and viscous after a reaction time of 20 hours. The reaction product was diluted with about 100 ml of heptane and quenched with 20 ml of a 5% aqueous sodium hydroxide solution. The organic layer was washed with water three times, dried by magnesium sulfate and filtered. The conversion of the alpha-olefins was 96.5% and selectivity to $C_{30}$+ lube range material was 97.6%, as determined by gas chromatograph techniques.

Example 3

A second alpha-olefin mixture of $C_5$ to $C_{18}$ prepared by wax cracking, atmospheric distillation and vacuum distillation was used in this example. Eight grams of this alpha-olefin mixture and 0.4 grams of solid $AlCl_3$ catalyst were mixed at room temperature and stirred overnight. The solution became dark red and viscous after a reaction time of 20 hours. The reaction product was diluted with about 100 ml of heptane and quenched with 20 ml of a 5% aqueous sodium hydroxide solution. The organic layer was washed with water three times, dried by magnesium sulfate and filtered. The olefin conversion was 80% and selectivity to lube fraction was 93.7, as determined by isolated product weight. The lube fraction had a kinematic viscosity (Kv) at 100° C.=49.89 cS, Kv at 40° C.=596.35 cS and a VI=140. As may be appreciated, this is a very high VI and compares favorably to a PAO made from 1-decene, which typically yields a kinematic viscosity at 100° C. of 40 cS, with a VI of 140.

Example 4

The alpha-olefin mixture of Example 3 was used for this example. The alpha-olefin mixture was purified by soaking with 20 wt. % activated 13× molecular sieve and 20 wt. % oxygenate removal catalyst for 2 days. In a small reactor, 1.0176 gram of a tri-isobutylaluminum (TIBA) stock solution containing 20 mg TIBA/gram toluene was added. The mixture was stirred for 10 minutes, followed by the addition of 0.1459 gram of a metallocene stock solution containing 1 mg of dimethylsilyl[tetrahydroindenyl]zirconium dichloride per gram of toluene and 0.2564 gram of an activator stock solution containing 1 mg of N,N-dimethylanilinium tetrakis[pentafluorophenyl]borate per gram of toluene. The reaction mixture was allowed to stir for 20 hours at room temperature. The reaction mixture gelled and the product was worked up by diluting with toluene. The semi-solid was isolated by filtering to remove the solvent. The semi-solid after drying at 100° C./1 milli-torr was isolated, with a 67% yield. The product so produced had a consistency useful for adhesives or additives to adhesives, filler etc.

Example 5

The alpha-olefin mixture of Example 3 was used again for this example. In this example, however, the polymerization reaction was carried out at 70° C. After conducting the reaction for 20 hours, the reaction mixture was diluted with 30 ml n-heptane and 1 gram activated alumina was added and stirred for 30 minutes and then filtered. The lube product was isolated by distillation at 110° C. with full vacuum. The lube has kinematic viscosity (Kv) at 100° C.=90.72, Kv at 40° C.=622.10 and VI=237. As may be appreciated, this fluid had outstanding VI, much higher than a traditional HVI-PAO.

Example 6

A third alpha-olefin mixture of $C_5$ to $C_{18}$ prepared by wax cracking, atmospheric distillation and vacuum distillation was used in this example. The alpha-olefin mixture was purified by soaking with 20 wt. % activated 13× molecular sieve and 20 wt. % oxygenate removal catalyst for 2 days. In a small reactor, 1.0176 gram of a tri-isobutylaluminum (TIBA) stock solution containing 20 mg TIBA/gram toluene was added. The mixture was stirred for 10 minutes, followed by the addition of 0.1459 gram of a metallocene stock solution containing 1 mg of dimethylsilyl[tetrahydroindenyl]zirconium dichloride per gram of toluene and 0.2564 gram of an activator stock solution containing 1 mg of N,N-dimethylanilinium tetrakis[pentafluorophenyl]borate per gram of toluene. The reaction mixture was allowed to stir for 20 hours at room temperature. The reaction mixture gelled and the product was worked up by diluting with toluene. The semi-solid was isolated by filtering to remove the solvent. The semi-solid after drying at 100° C./1 milli-torr was isolated. The isolated lube product had Kv at 100° C.=25.90 cS, Kv at 40° C.=142.56 and a VI=218. Again, this fluid had outstanding VI, much higher than a traditional HVI-PAO.

As may be appreciated, these data demonstrate that high VI poly alpha olefins may be produced from Fisher-Tropsch wax-derived alpha-olefins; higher than even those that are produced from commercial linear alpha-olefins. Moreover, the Fisher-Tropsch wax-derived alpha-olefins have higher linear alpha-olefin content than traditional slack wax derived olefins.

Furthermore, these data also demonstrated that the Fisher-Tropsch wax-derived olefins disclosed herein have high reactivity over conventional $AlCl_3$ or metallocene catalysts. This is contrary to certain teachings that have indicated that the oxygenates present in thermally cracked Fisher-Tropsch waxes can inhibit polymerization reactions to the point that an additional hydrotreating step to remove the oxygenates, prior the cracking step, is required.

All patents, test procedures, and other documents cited herein, including priority documents, are fully incorporated by reference to the extent such disclosure is not inconsistent with this disclosure and for all jurisdictions in which such incorporation is permitted.

While the illustrative forms disclosed herein have been described with particularity, it will be understood that various other modifications will be apparent to and can be readily made by those skilled in the art without departing from the spirit and scope of the forms disclosed herein. Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which this disclosure pertains.

What is claimed is:

1. A process for preparing poly alpha olefins from a Fisher-Tropsch liquid, the process comprising the steps of:

(a) contacting an unpurified $C_5$-$C_{18}$ fraction of an alpha-olefinic hydrocarbon mixture produced from thermal cracking a $C_{20}$-$C_{25}$ Fisher-Tropsch product with an oligomerization catalyst under conditions to produce an oligomerized product, wherein said conditions include a temperature between 0° C. and 250° C. for a time sufficient to produce the oligomerized product;

wherein the oligomerization catalyst comprises promoted aluminum trichloride, wherein the oligomerization step olefin conversion is at least 80% and the selectivity to $C_{30}$+ lube range material is at least 93.7%, and (b) fractionating the oligomerized product to obtain a fractionated product having an average carbon number greater than 24, and wherein the $C_{20}$-$C_{25}$ Fisher-Tropsch product is produced from the following process steps:

(c) heating a Fisher-Tropsch liquid and flashing off or distilling off light material at a pressure greater than one atmosphere and recovering a bottoms stream;

(d) vacuum fractionating the bottoms stream to form a $C_{19-}$ overhead stream, a $C_{20}$-$C_{25}$ Fisher-Tropsch product; and a $C_{26+}$ bottoms stream, and with the proviso that the $C_{20}$-$C_{25}$ Fisher-Tropsch product is produced without a hydrotreating step to remove oxygenates either before or after the heating step of (c).

2. The process of claim 1, wherein the Fisher-Tropsch product is a $C_{20}$-$C_{24}$ Fisher-Tropsch product.

3. The process of claim 1, wherein the fractionated product has a viscosity at 100° C. of 3 to 1000 cS for use as a lubricant base stock.

4. The process of claim 1, further comprising the step of contacting the fractionated product with a hydrogenation catalyst and recovering a hydrogenated lubricant base stock.

5. The process of claim 1, wherein said temperature is 50° C.

6. The process of claim 1, wherein the Fisher-Tropsch product is thermally cracked at a temperature between 500° C. and 650° C. at a pressure from 50 kPa to 1050 kPa.

7. The process of claim 6, wherein the Fisher-Tropsch product is thermally cracked at a temperature of 540° C.

8. The process of claim 1, further comprising the step of contacting the fractionated product with hydrogen and a hydrogenation catalyst.

9. The process of claim 8, wherein the hydrogenation catalyst is nickel, platinum or palladium-supported on kiesleghur, silica, alumina, zeolites, clay or silica-alumina.

10. The process of claim 1, further comprising the step of blending the fractionated product with a hydroisomerized Fisher-Tropsch wax product or other light lubricant base stock.

11. The process of claim 1, wherein the thermal cracking of the $C_{20}$-$C_{25}$ Fisher-Tropsch product yields a per pass conversion of 22 to 35% of $C_{20}$-$C_{25}$ feed to the thermal cracker to $C_{18-}$ product produced from the thermal cracker.

12. The process of claim 11, wherein the $C_{19+}$ fraction of the effluent from the thermal cracker is substantially recycled back to the thermal cracker.

13. A process for preparing lubricant base stocks from a Fisher-Tropsch liquid, the process comprising the steps of:

(a) heating a Fisher-Tropsch liquid and flashing off or distilling off light material at a pressure greater than one atmosphere and recovering a bottoms stream;

(b) vacuum fractionating the bottoms stream to form a $C_{19-}$ - overhead stream, a $C_{20}$-$C_{25}$ Fisher-Tropsch product; and a $C_{26+}$ bottoms stream with the proviso that the $C_{20}$-$C_{25}$ Fisher-Tropsch product is produced without a hydrotreating step to remove oxygenates either before or after the heating step of (a);

(c) thermally processing the $C_{20}$-$C_{25}$ Fisher-Tropsch product to obtain a product containing at least 60% linear alpha-olefins;

(d) separating a $C_5$-$C_{18}$ fraction from the thermally processed product of step (c);

(e) contacting the unpurified $C_5$-$C_{18}$ fraction with an oligomerization catalyst under conditions to produce an oligomerized product, wherein said conditions include a temperature between 0° C. and 250° C. for a time sufficient to produce the oligomerized product;

wherein the oligomerization catalyst comprises promoted aluminum trichloride, wherein the oligomerization step olefin conversion is at least 80% and the selectivity to $C_{30+}$ lube range material is at least 93.7%, (f) separating the reaction mixture from the catalyst; and (g) fractionating the oligomerized product to obtain a fractionated product having an average carbon number greater than 30.

14. The process of claim 13, wherein the Fisher-Tropsch product is thermally cracked at a temperature between 500° C. and 650° C. at a pressure from 50 kPa to 1050 kPa.

15. The process of claim 13, further comprising the step of blending the fractionated product with a hydroisomerized Fisher-Tropsch wax product or other light lubricant base stock.

16. The process of claim 13, wherein the thermal cracking of the $C_{20}$-$C_{25}$ Fisher-Tropsch product of step (c) yields a per pass conversion of 22 to 35% of $C_{20}$-$C_{25}$ feed to the thermal cracker to $C_{18-}$ product produced from the thermal cracker.

17. The process of claim 16, wherein the $C_{19+}$ fraction of the effluent from the thermal cracker is substantially recycled back to the thermal cracker.

* * * * *